US006160529A

United States Patent [19]

Asao et al.

[11] Patent Number: 6,160,529

[45] **Date of Patent: *Dec. 12, 2000**

[54] METHOD OF DRIVING PLASMA DISPLAY PANEL, AND DISPLAY APPARATUS USING THE SAME

[75] Inventors: Shigeharu Asao; Haruo Koizumi; Yoshikazu Kanazawa, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/917,332

[22] Filed: Aug. 25, 1997

[30] Foreign Application Priority Data

Jan. 27, 1997 [JP] Japan ..... 9-012700

[51] Int. Cl.[7] ..... G09G 3/28

[52] U.S. Cl. ..... 345/60; 345/68

[58] Field of Search ..... 345/60, 68; 315/169.1, 315/169.4

[56] References Cited

U.S. PATENT DOCUMENTS

| | | | |
|---|---|---|---|
| 4,772,884 | 9/1988 | Weber et al. | 345/67 |
| 5,029,257 | 7/1991 | Kim | 315/169.4 |
| 5,436,634 | 7/1995 | Kanazawa | 345/67 |
| 5,446,344 | 8/1995 | Kanazawa | 315/169.4 |
| 5,656,893 | 8/1997 | Shino et al. | 315/169.4 |
| 5,854,540 | 12/1998 | Matsumoto et al. | 315/169.4 |

FOREIGN PATENT DOCUMENTS 0 762 373 3/1997 European Pat. Off. .

7-261699 10/1995 Japan .

OTHER PUBLICATIONS

Patent Abstracts of Japan for JP–A–02–220330 dated Sep. 3, 1990, entitled "Gas Discharge Panel and Method of Driving Same".

Patent Abstracts of Japan for JP–A–05–002993 dated Jan. 8, 1993, entitled "Surface Discharge Type Plasma Display Panel and Method for Driving It".

*Primary Examiner*—Richard A. Hjerpe
*Assistant Examiner*—Marthe Marc-Coleman
*Attorney, Agent, or Firm*—Staas & Halsey LLP

[57] ABSTRACT

A method of driving a plasma display panel having plural, parallel sustain and scan electrodes, corresponding to respective display lines, and plural address electrodes in opposed relationship and electrically isolated with respect to the sustain and scan electrodes and intersecting same so as to form respective discharge cells at the intersections. The method produces an interlaced display by generating discharges in selected discharge cells, in odd and even fields, between respective, different sets of the sustain and scan electrodes. Each of the odd and even fields includes a reset period in which a reset discharges are produced in the discharge cells to establish a uniform charge distribution therein, an address period in which write discharges are produced in selected discharge cells in accordance with display data and a sustain discharge period in which sustain discharge pulses are produced in the written discharge cells to establish a glow discharge, for display during the respective periods. Potential differences between the respective sets of the sustain and scan electrodes of the odd and even fields are held below a discharge initiating voltage level, thereby avoiding the otherwise occurring problem of contrast drop.

34 Claims, 20 Drawing Sheets

METHOD OF DRIVING PLASMA DISPLAY PANEL, AND DISPLAY APPARATUS USING THE SAME

CROSS-REFERENCE TO RELATED APPLICATION

The subject application is related to co-pending U.S. application Ser. No. 08/690,038, filed Jul. 31, 1996.

BACKGROUND OF THE INVENTION

1. Field of the Invention

The present invention relates to a method of driving a display panel constructed with an array of discharge cells which are display elements having memory capability, and more particularly to a method of driving a plasma display panel (PDP) and also to a plasma display panel and a display apparatus using the same method.

An AC (alternating current) PDP produces a display by light emission while sustaining discharge by applying voltage pulses alternately to a pair of sustain electrodes. The discharge itself completes in one to several microseconds after application of the voltage pulse, but ions, i.e., positive charges generated as a result of the discharge, are accumulated on the surface of an insulating layer overlying the electrode supplied with a negative voltage. On the other hand, electrons, i.e., negative charges generated at the same time, are accumulated on the surface of an insulating layer overlying the electrode supplied with a positive voltage. These accumulated positive and negative charges are called wall charges. Therefore, once the wall charges have been formed by causing a discharge with the application of a high voltage pulse (write pulse), the threshold voltage required to cause a discharge is exceeded by just applying a voltage pulse (sustain discharge pulse) lower than the initial voltage in such a manner as to be superimposed on the accumulated wall charges. That is, the AC PDP has the characteristic that a discharge cell, once subjected to a write discharge with the resulting formation of a wall charge, can be maintained in the discharging state by just applying the sustain discharge pulse alternately in reverse polarity. This is called the memory effect or memory capability. Generally, AC PDPs display images using this memory effect.

2. Description of the Related Art

FIGS. 10 to FIG. 13*b* show an interlaced plasma display panel (PDP) and a method of driving the same, a patent application on which was already filed by the present applicant (Japanese Patent Application NO. 8-194320).

FIG. 10 is a plan view showing the interlaced PDP. Scan electrodes $Y_n$ and sustain electrodes $X_i$, extending in parallel to each other, are paired in adjacent positions, each pair forming one display line. On the other hand, address electrodes $A_j$ are arranged intersecting at right angles with the scan electrodes $Y_n$ and sustain electrodes $X_i$ and form a discharge cell in each intersection region. For simplicity, four scan electrodes $Y_1$ to $Y_4$, five sustain electrodes $X_1$ to $X_5$, and five address electrodes $A_1$ to $A_5$ are shown in the figure, but actually, a large number of such electrodes are provided according to the required display resolution. Each discharge cell is spatially decoupled from horizontally adjacent discharge cells by barriers 2 (also called ribs).

Of the sustain electrodes $X_i$, the odd-numbered electrodes are connected to an X-common driver A, and the even-numbered electrodes are connected to an X-common driver B. In FIG. 10, the X-common driver A is indicated by reference numeral 31, and the X-common driver B by reference numeral 32. The X-common drivers A and B supply pulses such as a blanket write pulse for a reset discharge and a sustain discharge pulse (Vs) to the sustain electrodes $X_i$. On the other hand, the scan electrodes $Y_n$ are individually connected to Y-scan drivers 4 and are independently driven by the respective Y-scan drivers 4. Of the scan electrodes $Y_n$, the odd-numbered electrodes $Y_{2n-1}$ are connected to a Y-common driver A, and the even-numbered electrodes $Y_{2n}$ are connected to a Y-common driver B. In FIG. 10, the Y-common driver A is indicated by reference numeral 51, and the Y-common driver B by reference numeral 52. When performing a write discharge in accordance with an input signal, scan pulses (−Vy) to be applied to the respective scan electrodes $Y_n$ are supplied from the respective Y-scan drivers 4, and when performing a sustain discharge for display based on the write discharge, sustain pulses (Vs) to be applied to the respective scan electrodes $Y_n$ are supplied from the Y-common drivers A and B to the scan electrodes $Y_n$ via the respective Y-scan drivers 4. The address electrodes $A_j$ are individually connected to address drivers not shown, and are independently driven by the respective address drivers.

The feature of the above-described interlaced driving method is that the discharge is carried out by utilizing slits (electrode gaps) located on both sides of each of the scan electrodes $Y_n$. More specifically, in conventional three-electrode, surface-discharge PDPs, the slits used for discharging were predetermined at the beginning, such as the slits between $Y_1$ and $X_1$, between $Y_2$ and $X_2$, and so on. As a result, to obtain N display lines, a total of N×2 electrodes, the scan electrodes $Y_n$ and sustain electrodes $X_i$ combined, were required. This impeded the realization of high-resolution panels. On the other hand, with the above interlaced method, by dividing the X-common driver into two sections A and B it has become possible to supply different signals to the sustain electrodes $X_i$ and $X_{i+1}$ located adjacent on both sides of each scan electrode $Y_n$ to which the scan signal is supplied.

When performing discharging in accordance with a video signal, a discharge is caused between the scan electrode $Y_n$ and address electrode $A_j$ by an address signal supplied to the address electrode in synchronism with the scan signal, and using this discharge as a trigger, a discharge is also caused between the scan electrode $Y_n$ and a sustain electrode $X_i$ adjacent thereto, thereby accomplishing the writing. In the interlaced method, one or the other of the two sustain electrodes $X_i$ and $X_{i+1}$ adjacent to the scan electrode $Y_n$ can be selected for the discharge to be caused between the scan electrode $Y_n$ and the selected sustain electrode $X_i$ or $X_{i+1}$. That is, with the above method, all the slits can be used for discharging, which means that a total of N+1 electrodes, the scan electrodes $Y_n$ and sustain electrodes $X_i$ combined, are required to obtain N display lines. In other words, the number of display lines can be almost doubled while using the same number of electrodes as the previous method.

FIG. 11 is a cross-sectional view showing the above-described interlaced PDP. Discharge space 13 is formed between two glass substrates 11 and 14 disposed opposite each other. The scan electrodes $Y_n$ and sustain electrodes $X_i$, extending parallel to each other, are formed on the front glass substrate 14; each of these electrodes consists of a transparent electrode 15 and a bus electrode 16. The transparent electrode 15 is formed from indium tin oxide (ITO) or the like, and transmits light reflected from a phosphor not shown. On the other hand, the bus electrode 16 is formed on top of the transparent electrode 15 in order to prevent a voltage drop due to the transparent electrode 15 which has a relatively large resistance compared to an ordinary wiring metal. Since it is opaque, the bus electrode 16 must be formed as a thin line so as not to reduce the display area. These electrodes are covered with a dielectric layer 17.

On the other hand, on the back glass substrate 11 disposed opposite the front glass plate 14 are formed the address electrodes $A_j$ intersecting at right angles with the scan electrodes $Y_n$ and the sustain electrodes $X_i$. Like the scan electrodes $Y_n$ and sustain electrodes $X_i$, the address electrodes $A_j$ are also covered with a dielectric layer 12. Though not shown here, phosphors having red, green, and blue light emitting properties are formed covering the address electrodes.

In conventional PDPs, since the slits used for discharging are predetermined, the bus electrode 16 is often formed on one edge of the transparent electrode 15. In the above interlaced PDP, on the other hand, since the slits used for discharging are not predetermined, the bus electrode 16 is disposed approximately in the center of the transparent electrode 15. L1 to L3 indicate the slits. In the figure, the discharge is shown as occurring in the slits L1 and L3, but at the next timing, the discharge occurs in the slit L2; in this way, selective discharging is carried out on all the slits.

FIG. 12 shows a frame structure according to the interlaced method, illustrating one image display frame in the above interlaced PDP. This structure is disclosed in the aforementioned Japanese Patent Application No. 8-194320. The frame structure is based on the "ADS Subfield Method (Japanese Patent Application No. 5-310937)" wherein an address period (A), during which a write discharge is carried out in accordance with display data, and a sustain period (S), during which a sustain discharge (display) is carried out based on the written data, are separated in time, and a gradation display is produced by combining a plurality of differently weighted subfields. In practice, a reset period (R) for initialization is placed before the address period.

One frame is divided into an odd field and an even field, each field consisting of the plurality of subfields (in the illustrated example, the first to the third subfield). In the odd field, for example, the slits L1 and L3 in FIG. 10 are used to produce the display, while in the even field the slit L2 in FIG. 10 is used. In the subfields, the sustain periods are T1, 2T1, and 4T1, respectively, and the sustain discharge is carried out the number of times that is substantially proportional to the length of the period. By selecting the subfields as desired, a display with 8 gray scale levels can be achieved. In like manner, if the number of subfields is set to 8, and the ratio among the sustain periods is chosen to be 1:2:4:8:16:32:64:128, a display with 256 gray scale levels can be achieved. Here, the sustain period ratio need not necessarily be set in a geometric progression manner; rather, more than one subfield may be set with the same number of sustain discharges, or the number of discharges may be adjusted according to the actual display brightness.

FIGS. 13*a* and 13*b* are waveform diagrams illustrating the prior art interlaced driving. As stated above, one frame is divided into two portions, an odd field and an even field, each of which is further divided into a plurality of subfields. In the figures, only one subfield is shown from each of the odd and even fields. Each subfield consists of a reset period, an address period, and a sustain period. The reset period is for resetting the wall charges remaining from the immediately preceding subfield, the address period is for performing a write discharge according to display data and thereby accumulating wall charges within designated discharge cells, and the sustain period is for performing a sustain discharge to produce a display in the discharge cells where the wall charges have been accumulated during the address period.

First, the driving for the odd field will be described. In the reset period, a blanket write pulse Vs+Vw is applied to all the sustain electrodes $X_i$. Since all the scan electrodes are held at ground potential, the potential difference Vs+Vw between the sustain electrodes $X_i$ and scan electrodes $Y_n$ exceeds the discharge initiating voltage between the electrodes, accomplishing the reset discharge between all the electrodes, i.e., in all the slits. At this time, a pulse Vaw is applied to the address electrodes $A_j$ to reduce the potential difference with respect to the sustain electrodes $X_i$ in order to prevent a discharge from occurring between them. As the result of the blanket write discharge in all the slits, excessive wall charges of different polarities are accumulated on the respective electrodes. When all the electrodes are brought to the same potential (in this case, ground potential) after applying the write pulse, the potential difference of the wall charge itself exceeds the discharge initiating voltage, and a self-erase discharge occurs, which neutralizes and erases the wall charge on each electrode.

The address period is further divided into the first half and second half portions. In the first half portion, for example, the odd-numbered scan electrodes $Y_{2n-1}$ are scanned in sequence, and in the second half portion, the even-numbered scan electrodes are scanned in sequence. In the first half portion, a scan pulse −Vy is applied in sequence to the scan electrodes $Y_{2n-1}$. This scan pulse −Vy is applied in such a manner as to be superimposed on a base pulse −Vsc which is maintained throughout the address period. In synchronism with the scan pulse −Vy, an address pulse (data) Va is selectively applied to the address electrodes $A_j$, thereby accomplishing the write discharge between the scan electrodes $Y_{2n-1}$ and the selected address electrodes $A_j$. At this time, of the sustain electrodes $X_i$, only the odd-numbered electrodes $X_{2i-1}$ are held at potential Vx throughout the first half period; this makes it possible to specify slits for discharging. That is, the discharge fired by the write discharge occurs only between the scan electrodes $Y_{2n-1}$ and the sustain electrodes $X_{2i-1}$ supplied with the pulse Vx, and wall charges are accumulated in the discharge cells formed by the scan electrodes $Y_{2n-1}$ and the sustain electrodes $X_{2i-1}$.

Next, in the second half portion of the address period, the remaining even-numbered scan electrodes $Y_{2n}$ are scanned in sequence, in synchronism with which the address pulse Va is selectively applied to the address electrodes $A_j$. At the same time, the pulse Vx is applied only to the even-numbered sustain electrodes $X_{2i}$, as a result of which the discharge is selectively caused between the scan electrodes $Y_{2n}$ and the sustain electrodes $X_{2i}$ and wall charges are accumulated.

In the sustain period, by applying the sustain discharge pulse Vs alternately to the scan electrodes $Y_n$ and the sustain electrodes Xi, the sustain discharge for display is carried out on the discharge cells where the wall charges have been accumulated during the address period. At this time, in the odd field, the odd-numbered scan electrodes $Y_{2n-1}$ and the even-numbered sustain electrodes $X_{2i}$, and the even-numbered scan electrodes $Y_{2n}$ and the odd-numbered sustain electrodes $X_{2i-1}$, are respectively maintained in phase, so that a potential difference does not occur in the slits between the respective electrodes and the sustain discharge does not take place in these slits. In this way, in the odd field, the sustain discharge takes place only between the odd-numbered electrodes and between the even-numbered electrodes.

The driving for the subsequent even field will be described next. In the reset period, the same operation as in the first described odd field is performed, likewise accomplishing the reset discharge in all the slits which is followed by the self-erase discharge.

In the address period, on the other hand, in the first half portion the odd-numbered scan electrodes $Y_{2n-1}$ are likewise scanned in sequence, but at this time, of the sustain electrodes $X_i$, the even-numbered sustain electrodes $X_{2i}$ are held at the potential Vx. As a result, in the even field, the discharge fired by the write discharge occurs only between the odd-numbered scan electrodes $Y_{2n-1}$ and even-numbered sustain electrodes $X_{2i}$, and wall charges are accumulated in the discharge cells formed by the scan electrodes $Y_{2n-1}$ and the sustain electrodes $X_{2i}$.

Next, in the second half portion of the address period, the remaining even-numbered scan electrodes $Y_{2n}$ are scanned in sequence and, at the same time, the pulse Vx is applied only to the odd-numbered sustain electrodes $X_{2i-1}$, as a result of which the discharge is selectively caused between the scan electrodes $Y_{2n}$ and the sustain electrodes $X_{21-l}$ and wall charges are accumulated.

In the sustain period that follows, the odd-numbered electrodes and the even-numbered electrodes are respectively maintained in phase, so that potential difference does not occur in the slits between the respective electrodes and the sustain discharge does not take place in these slits. In this way, in the even field, sustain discharge takes place only between the odd-numbered electrodes and even-numbered electrodes.

The above driving method, however, has had a problem in that the contrast decreases due to the reset discharge.

It has generally been said that one of the problems facing PDPs is their low contrast compared with CRTs and other display devices. One of the causes for low contrast has been the unwanted light emission caused by the reset discharge. More specifically, in a PDP, the light emission that directly contributes to the display of an image is that caused by the sustain discharge, but on the other hand, discharging during other periods also produces light emission; it has therefore been pointed out that the unwanted light emission by the reset discharge that does not directly contribute to the display of an image contributes to reducing the black level during non-display periods.

It has been confirmed by experiments conducted by the present inventor et al. that when the interlaced method is employed, the contrast tends to further decrease. The cause has been the discharge that occurs in all the slits during the reset period. That is, in the odd field, the slits between the odd-numbered electrodes and the slits between the even-numbered electrodes are actually subjected to sustain discharge, but the reset discharge is also performed on the remaining slits. Likewise, in the even field, the slits between the odd-numbered electrodes and even-numbered electrodes are actually subjected to sustain discharge, but the reset discharge is also performed on the remaining slits. As a result, in the interlaced method, the reset discharge is performed twice on each slit, once each in the odd field and in the even field. In non-interlaced PDPs, reset discharge is performed once on each line in one subfield; therefore, by simple comparison, the number of reset discharges is doubled. This has been a serious problem faced by the interlaced method intended for a high-resolution panel.

SUMMARY OF THE INVENTION

An object of the present invention is to provide a method for solving the problem of contrast drop inherent in interlaced plasma display panels, and also to provide a plasma display panel and a display apparatus using the same method.

According to a first aspect of the present invention, there is provided a method of driving a plasma display panel in which a plurality of sustain electrodes $X_i$ and a plurality of scan electrodes $Y_n$ are arranged parallel to each other on a first substrate in a corresponding relationship to an equal number of display lines, and a plurality of address electrodes $A_j$ electrically isolated from the sustain electrodes $X_i$ and the scan electrodes $Y_n$ are arranged on a second substrate opposing the first substrate, in such a manner as to intersect with the sustain electrodes $X_i$ and scan electrodes $Y_n$, forming a discharge cell in each intersection region, comprising: an odd field in which a display is produced between odd-numbered sustain electrodes $X_{2i-1}$ and scan electrodes $Y_{2n-1}$ and between even-numbered sustain electrodes $X_{2i}$ and scan electrodes $Y_{2n}$, and an even field in which a display is produced between the odd-numbered sustain electrodes $X_{2i-1}$ and even-numbered scan electrodes $Y_{2n}$ and between the even-numbered sustain electrodes $X_{2i}$ and odd-numbered scan electrodes $Y_{2n-1}$, each of the odd and even fields including: a reset period in which a reset discharge is carried out in a plurality of discharge cells by applying prescribed voltages to the sustain electrodes $X_i$, scan electrodes $Y_n$, and address electrodes $A_j$ to accomplish a uniform charge distribution among the plurality of discharge cells; an address period in which a write discharge is carried out in selected discharge cells between the scan electrodes $Y_n$ and the address electrodes $A_j$, thereby performing selective writing that matches display data; and a sustain discharge period in which sustain discharge pulses are applied between the sustain electrodes $X_i$ and the scan electrodes $Y_n$, thereby causing a discharge glow for the display at the discharge cells in which the writing has been performed in the address period, wherein potential differences between the odd-numbered sustain electrodes $X_{2i-1}$ and the even-numbered scan electrodes $Y_{2n}$ and between the even-numbered sustain electrodes $X_{2i}$ and the odd-numbered scan electrodes $Y_{2n-1}$ during the reset period of the odd field, and potential differences between the odd-numbered sustain electrodes $X_{2i-1}$ and scan electrodes $Y_{2n-1}$ and between the even-numbered sustain electrodes $X_{2i}$ and scan electrodes $Y_{2n}$ during the reset period of the even field, are each held below a discharge initiating voltage between the respective electrodes.

In the method of the present invention, during the reset period of each of the odd and even fields, the voltage applied to the slits that are not contributing to the display of an image, that is, the slits where the sustain discharge is not carried out, is held below the discharge initiating voltage. As a result, the reset discharge occurs only in the slits that are contributing to the display, and no reset discharge occurs in the slits that are not contributing to the display. This serves to reduce the unwanted discharge that does not contribute to the display, and a contrast drop can thus be prevented.

Also, according to a second aspect of the present invention, there is provided a plasma display panel in which a plurality of sustain electrodes $X_i$ and a plurality of scan electrodes $Y_n$ are arranged parallel to each other on a first substrate in corresponding relationship to an equal number of display lines, and a plurality of address electrodes $A_j$ electrically isolated from the sustain electrodes $X_i$ and scan electrodes $Y_n$ are arranged on a second substrate opposing the first substrate, in such a manner as to intersect with the sustain electrodes $X_i$ and scan electrodes $Y_n$, forming a discharge cell in each intersection region, comprising: an odd field in which a display is produced between odd-numbered sustain electrodes $X_{2i-1}$ and scan electrodes $Y_{2n-1}$ and between even-numbered sustain electrodes $X_{2i}$ and scan electrodes $Y_{2n}$, and an even field in which a display is produced between the odd-numbered sustain electrodes $X_{2i-1}$ and even-numbered scan electrodes $Y_{2n}$ and between the even-numbered sustain electrodes $X_{2i}$ and odd-numbered scan electrodes $Y_{2n-1}$, each of the odd and even fields including: a reset period in which a reset discharge is carried out in a plurality of discharge cells by applying prescribed voltages to the sustain electrodes $X_i$, the scan electrodes $Y_n$, and the address electrodes $A_j$ to accomplish a uniform charge distribution among the plurality of discharge cells; an address period in which a write discharge is carried out in selected discharge cells between the scan electrodes $Y_n$ and the address electrodes $A_j$, thereby performing selective writing that matches display data; and a sustain discharge period in which sustain discharge pulses are applied between the sustain electrodes $X_i$ and the scan electrodes $Y_n$, thereby causing a discharge glow for the display at the discharge cells in which the writing has been performed in the address period, wherein potential differences between the odd-numbered sustain electrodes $X_{2i-1}$ and the even-numbered scan electrodes $Y_{2n}$ and between the even-numbered sustain electrodes $X_{2i}$ and the odd-numbered scan electrodes $Y_{2n-1}$ during the reset period of the odd field, and potential differences between the odd-numbered sustain electrodes $X_{2i-1}$ and scan electrodes $Y_{2n-1}$ and between the even-numbered sustain electrodes $X_{2i}$ and scan electrodes $Y_{2n}$ during the reset period of the even field, are each held below a discharge initiating voltage between the respective electrodes.

Furthermore, according to a third aspect of the present invention, there is provided a display apparatus comprising: a plasma display panel in which a plurality of sustain electrodes $X_i$ and a plurality of scan electrodes $Y_n$ are arranged parallel to each other on a first substrate in a relationship corresponding to an equal number of display lines, and a plurality of address electrodes $A_j$ electrically isolated from the sustain electrodes $X_i$ and scan electrodes $Y_n$ are arranged on a second substrate opposing the first substrate, in such a manner as to intersect with the sustain electrodes $X_i$ and scan electrodes $Y_n$, forming a discharge cell in each intersection region; and drive circuits for respectively driving the sustain electrodes $X_i$, scan electrodes $Y_n$, and address electrodes $A_j$, wherein there are provided an odd field in which a display is produced between odd-numbered sustain electrodes $X_{2i-1}$ and scan electrodes $Y_{2n-1}$ and between even-numbered sustain electrodes $X_{2i}$ and scan electrodes $Y_{2n}$, and an even field in which a display is produced between the odd-numbered sustain electrodes $X_{2i-1}$ and even-numbered scan electrodes $Y_{2n}$ and between the even-numbered sustain electrodes $X_{2i}$ and odd-numbered scan electrodes $Y_{2n-1}$, each of the odd and even fields including: a reset period in which a reset discharge is carried out in a plurality of discharge cells by applying prescribed voltages to the sustain electrodes $X_i$, scan electrodes $Y_n$, and address electrodes $A_j$ to accomplish a uniform charge distribution among the plurality of discharge cells; an address period in which a write discharge is carried out in selected discharge cells between the scan electrodes $Y_n$ and the address electrodes $A_j$, thereby performing selective writing that matches display data; and a sustain discharge period in which sustain discharge pulses are applied between the sustain electrodes $X_i$ and the scan electrodes $Y_n$, thereby causing a discharge glow for the display at the discharge cells in which the writing has been performed in the address period, wherein potential differences between the odd-numbered sustain electrodes $X_{2i-1}$ and the even-numbered scan electrodes $Y_{2n}$ and between the even-numbered sustain electrodes $X_{2i}$ and the odd-numbered scan electrodes $Y_{2n-1}$ during the reset period of the odd field, and potential differences between the odd-numbered sustain electrodes $X_{2i-1}$ and scan electrodes $Y_{2n-1}$ and between the even-numbered sustain electrodes $X_{2i}$ and scan electrodes $Y_{2n}$ during the reset period of the even field, are each held below a discharge initiating voltage between the respective electrodes.

DESCRIPTION OF THE PREFERRED EMBODIMENTS

Figure 1A:
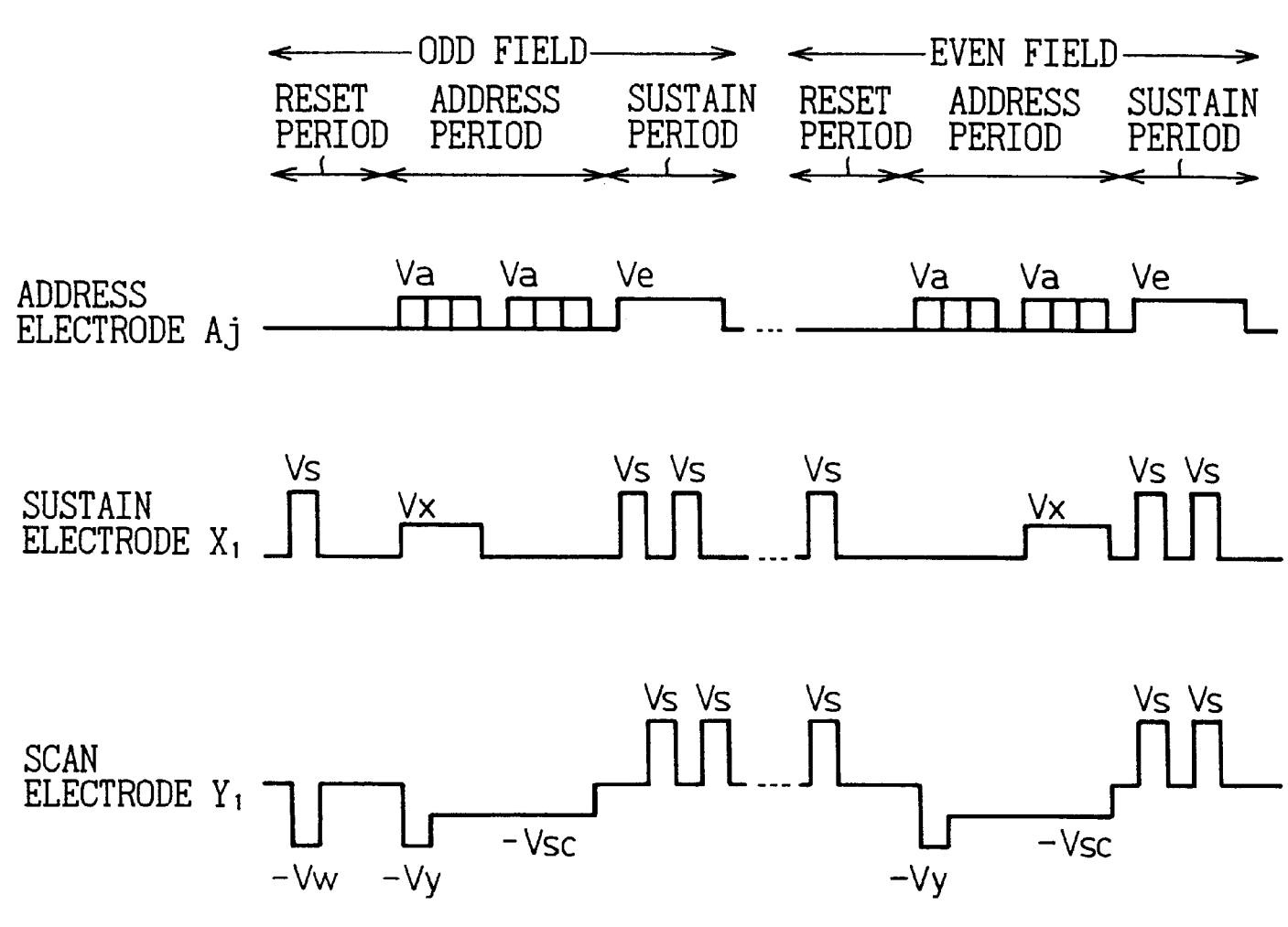
FIGS. 1*a* and 1*b* are waveform diagrams illustrating a first embodiment of the present invention.
Figure 1B:
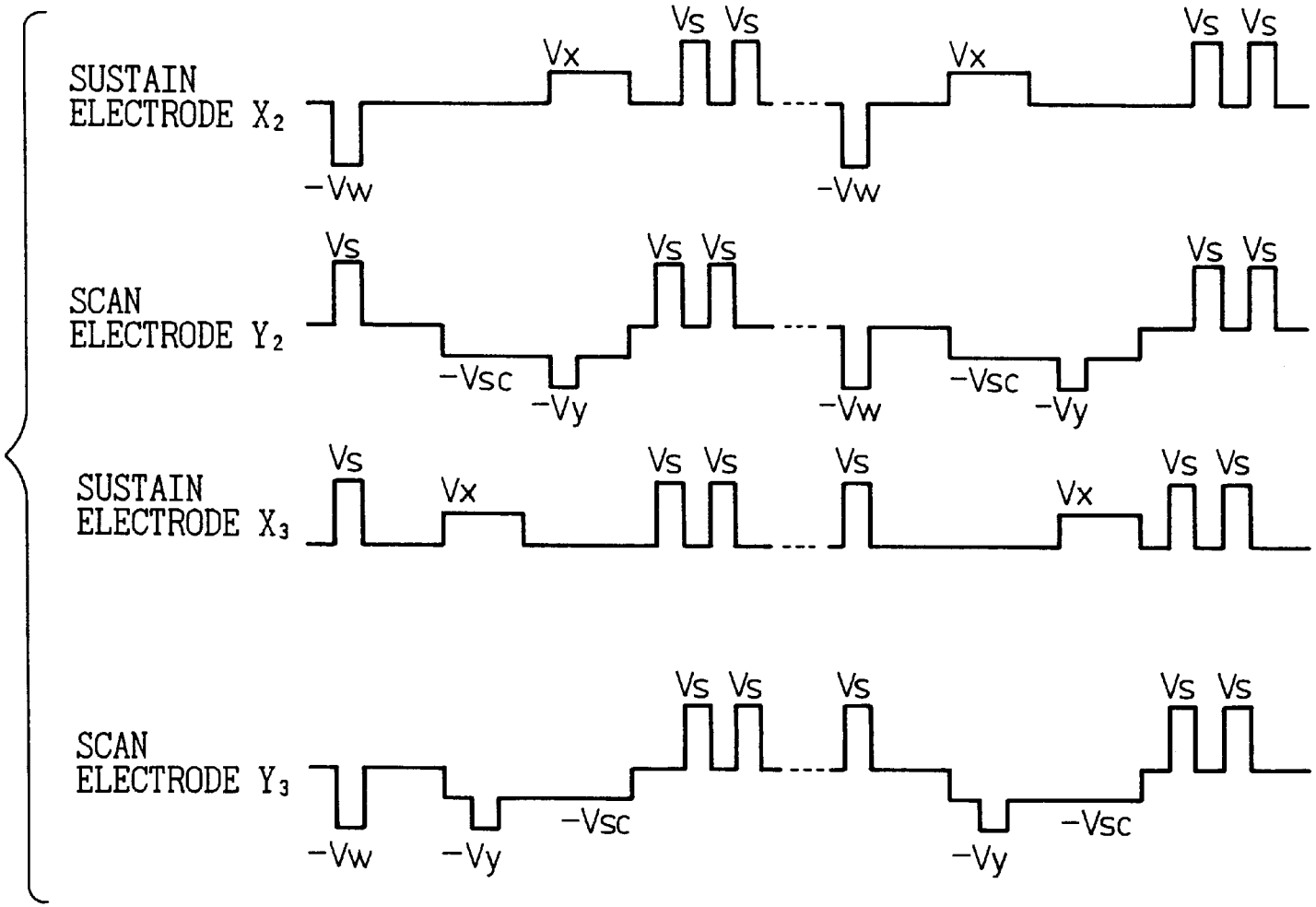
Figure 12:
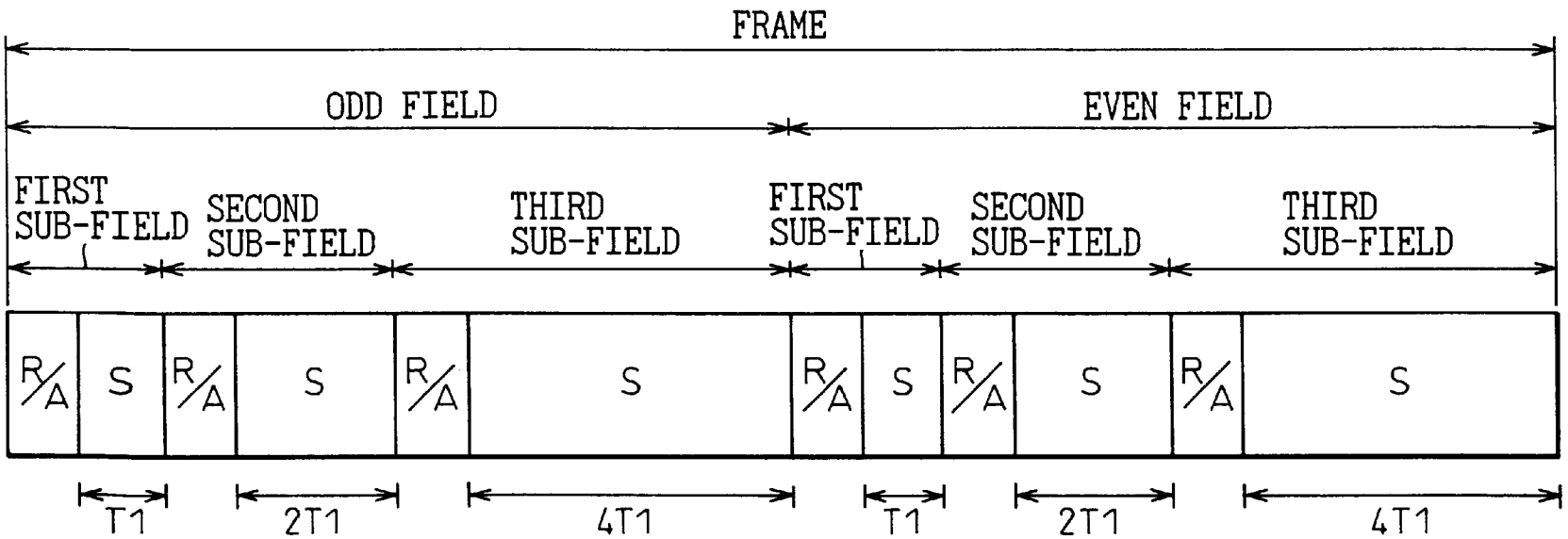
FIG. 12 is a diagram showing a frame structure according to an interlaced method.

FIGS. 1*a* and 1*b* are waveform diagrams illustrating a first embodiment of the present invention; shown here are waveforms in one frame which consists of an odd field and an even field. Actually, the odd and even fields each consist of a plurality of subfields having different sustain period lengths, as shown in FIG. 12, but for simplicity, only one subfield is shown here for each field.

As shown, each subfield consists of a reset period, an address period, and a sustain period. When the preceding subfield is completed, wall charges corresponding to the display in that subfield remain, so that a reset discharge is carried out in the reset period at the beginning of the next subfield. This discharge is a strong discharge caused by applying between sustain electrodes Xi and scan electrodes $Y_n$ a voltage exceeding the discharge initiating voltage between the electrodes, and is carried out to even out the charge distribution among discharge cells, regardless of the discharge state in the immediately preceding subfield. In the present invention, each electrode potential at the time of reset discharge is set so that for display slits the potential difference between electrodes becomes larger than the discharge initiating voltage, and for non-display slits the potential difference between electrodes becomes smaller than the discharge initiating voltage.

The driving in the odd field according to the present embodiment will be described first. In the odd field, a pulse Vs of positive polarity is applied to the odd-numbered sustain electrodes $X_1, X_3, \ldots, X_{2i-1}$ (i is a natural number), and a pulse −Vw of negative polarity is applied to the odd-numbered scan electrodes $Y_1, Y_3, \ldots, Y_{2n-1}$ (n is a natural number). At the same time, the negative polarity pulse −Vw is applied to the even-numbered sustain electrodes $X_2, X_4, \ldots, X_{2i}$, and the positive polarity pulse Vs is applied to the even-numbered scan electrodes $Y_2, Y_4, \ldots, Y_{2n}$. As a result, the potential difference between the odd-numbered sustain electrodes and scan electrodes, $X_1$-$Y_1$, $X_3$-$Y_3$, . . . , $X_{2i-1}$-$Y_{2n-1}$, and that between the even-numbered sustain electrodes and scan electrodes, $X_2$-$Y_2$, $X_4$-$Y_4$, . . . , $X_{2i}$-$Y_{2n}$, which form the display slits in the odd field, become Vs+Vw. With Vs+Vw set equal to or larger than the discharge initiating voltage between the electrodes, the reset discharge is carried out in each display slit. On the other hand, the potential difference between the odd-numbered scan electrodes and even-numbered sustain electrodes, $Y_1$-$X_2$, $Y_3$-$X_4$, . . . , $Y_{2n-1}$-$X_{2i}$, and that between the even-numbered scan electrodes and odd-numbered sustain electrodes, $Y_2$-$X_3$, $Y_4$-$X_5$, . . . , $Y_{2n}$-$Y_{2i-1}$, which form the non-display slits in the odd field, are both equal to zero, so that discharge does not occur between them. In this way, in the present embodiment, the reset discharge is carried out only for the display slits.

In the prior art, the pulse Vaw was applied to the address electrodes at the same time as the application of the blanket write pulse, but this is not necessary in the present embodiment, because the voltage applied to the sustain electrodes $X_i$ and scan electrodes $Y_n$ is lower than the corresponding voltage in the prior art and therefore, there is no possibility of causing a discharge between these electrodes and the address electrodes.

As a result of the reset discharge, excessive wall charges of opposite polarities are accumulated on both electrodes. Therefore, by making the potentials of both electrodes equal, and more specifically, by bringing them to ground potential, a self-erase discharge occurs to the wall charges which are thus neutralized.

In the address period that follows, a write discharge that matches input data (video data) is carried out. Here, we adopted the method in which writing to the odd-numbered electrodes is performed first, and then writing to the even-numbered electrodes is performed. More specifically, the scan pulse −Vy is applied in sequence to the odd-numbered scan electrodes, $Y_1, Y_3, \ldots, Y_{2n-1}$. Since the base pulse −Vsc is applied to each scan electrode $Y_n$ throughout the address period, the scan pulse −Vy is superimposed on the base pulse −Vsc. Data pulse Va is selectively applied to the address electrodes $A_j$ in accordance with the input signal, so that the discharge takes place between the selected address electrodes and the scan electrodes $Y_{2n-1}$ supplied with the scan pulse −Vy. At this time, in the odd field, since the pulse Vx is applied only to the odd-numbered sustain electrodes $X_1, X_3, \ldots, X_{2i-1}$, the write discharge is carried out only between the odd-numbered sustain electrodes and scan electrodes, $X_1$-$Y_1$, $X_3$-$Y_3$, . . . , $Y_{2i-1}$-$Y_{2n-1}$, and wall charges are thus accumulated on both electrodes. Next, the scan pulse −Vy is applied in sequence to the even-numbered scan electrodes $Y_2, Y_4, \ldots, Y_{2n}$. Here again, since the data pulse Va is selectively applied to the address electrodes $A_j$, and the pulse Vx is now applied only to the even-numbered sustain electrodes $X_2, X_4, \ldots, X_{2i}$, the write discharge is carried out only between the even-numbered sustain electrodes and scan electrodes, $X_2$-$Y_2$, $X_4$-$Y_4$, . . . , $Y_{2i}$-$Y_{2n}$, and wall charges are thus accumulated on both electrodes.

In the sustain period that follows, a sustain discharge pulse Vs is applied alternately to the sustain electrodes $X_i$ and scan electrodes $Y_n$ that form the display slits, thus carrying out a sustain discharge in the discharge cells in which the write discharge has been carried out. At this time, to prevent a discharge from occurring between the sustain electrodes $X_i$ and scan electrodes $Y_n$ that form the non-display slits, a voltage pulse of the same phase is applied to the sustain electrodes $X_i$ and scan electrodes $Y_n$ that form the non-display slits. More specifically, in the odd field, the sustain discharge pulse is applied alternately between the odd-numbered sustain electrodes and scan electrodes, $X_1$-$Y_1$, $X_3$-$Y_3$, . . . , $X_{2i-1}$-$Y_{2n-1}$, and also between the even-numbered sustain electrodes and scan electrodes, $X_2$-$Y_2$, $X_4$-$Y_4$, . . . , $X_{2i}$-$Y_{2n}$, which form the display slits, but this pulse is in phase between the odd-numbered scan electrodes and even-numbered sustain electrodes, $Y_1$-$X_2$, $Y_3$-$X_4$, . . . , $Y_{2n-1}$-$X_{2i}$, and also between the even-numbered scan electrodes and odd-numbered sustain electrodes, $Y_2$-$X_3$, $Y_4$-$X_5$, . . . , $Y_{2n}$-$Y_{2i-1}$, which form the non-display slits.

Next, in the even field, the display slits are now located between the odd-numbered scan electrodes and even-numbered sustain electrodes, $Y_1$-$X_2$, $Y_3$-$X_4$, . . . , $Y_{2n-1}$-$X_{2i}$, and also between the even-numbered scan electrodes and odd-numbered sustain electrodes, $Y_2$-$X_3$, $Y_4$-$X_5$, . . . , $Y_{2n}$-$Y_{2i-1}$. The applied voltage to each display slit is the same as that in the odd field. More specifically, in the even field, the positive polarity pulse Vs is applied to the odd-numbered scan electrodes $Y_1, Y_3, \ldots, Y_{2n-1}$ and the negative polarity pulse −Vw to the even-numbered sustain electrodes $X_2, X_4, \ldots, X_{2i}$. At the same time, the negative polarity pulse −Vw is applied to the even-numbered scan electrodes $Y_2, Y_4, \ldots, Y_{2n}$ and the positive polarity pulse Vs to the odd-numbered sustain electrodes $X_1, X_3, \ldots, X_{2i-1}$. As a result, the potential difference between the odd-numbered scan electrodes and even-numbered sustain electrodes, $Y_1$-$X_2$, $Y_3$-$X_4$, . . . , $Y_{2n-1}$-$X_{2i}$, and that between the even-numbered scan electrodes and odd-numbered sustain electrodes, $Y_2$-$X_3$, $Y_{4\text{-}X5}$, . . . , $Y_{2n}$-$Y_{2i-1}$, which form the display slits in the odd field, become Vs+Vw exceeding the discharge initiating voltage between the electrodes, and the reset discharge is thus carried out in each display slit. On the other hand, the potential difference between the odd-numbered sustain electrodes and scan electrodes, $X_1$-$Y_1$, $X_3$-$Y_3$, . . . , $X_{2i-1}$-$Y_{2n-1}$, and that between the even-numbered sustain electrodes and scan electrodes, $X_2$-$Y_2$, $X_4$-$Y_4$, . . . , $X_{2i}$-$Y_{2n}$, which form the non-display slits in the even field, are both equal to zero, so that discharge does not occur between them. In this way, the reset discharge is carried out only for the display slits. After completion of the reset discharge, a self-erase discharge occurs, as in the odd field, and the wall charges formed by the reset discharge are neutralized.

The driving in the address period that follows is essentially the same as that in the odd field, except that the display and non-display slits are interchanged. That is, the scan pulse −Vy is applied in sequence to the odd-numbered scan electrodes, $Y_1, Y_3, \ldots, Y_{2n-1}$, while at the same time the data pulse Va corresponding to the input signal is selectively applied to the address electrodes $A_j$. At this time, in the even field, since the pulse Vx is applied only to the even-numbered sustain electrodes $X_2, X_4, \ldots, X_{2i}$, the write discharge is carried out only between the odd-numbered scan electrodes and even-numbered sustain electrodes, $Y_1$-$X_2$, $Y_3$-$X_4$, . . . , $Y_{2n-1}$-$X_{2i}$, and wall charges are thus accumulated on both electrodes. Next, the scan pulse −Vy is applied in sequence to the even-numbered scan electrodes $Y_2$, $Y_4$, . . . , $Y_{2n}$. Here again, since the data pulse Va is selectively applied to the address electrodes $A_j$, and the pulse Vx is now applied only to the odd-numbered sustain electrodes $X_1$, $X_3$, . . . , $X_{2i-1}$, the write discharge is carried out only between the even-numbered scan electrodes and odd-numbered sustain electrodes, $Y_2$-$X_3$, $Y_4$-$X_5$, . . . , $Y_{2n}$-$X_{2i-1}$, and wall charges are thus accumulated on both electrodes.

In the sustain period that follows, the sustain discharge pulse Vs is applied alternately to the sustain electrodes $X_i$ and scan electrodes $Y_n$ that form the display slits, as in the odd field, carrying out the sustain discharge in the discharge cells in which the write discharge has been carried out. More specifically, in the even field, the sustain discharge pulse is applied alternately between the odd-numbered scan electrodes and even-numbered sustain electrodes, $Y_1$-$X_2$, $Y_3$-$X_4$, . . . , $Y_{2n-1}$-$X_{2i}$, and also between the even-numbered scan electrodes and odd-numbered sustain electrodes, $Y_2$-$X_3$, $Y_4$-$X_5$, . . . , $Y_{2n}$-$Y_{2i-1}$, which form the display slits, but this pulse is in phase between the odd-numbered sustain electrodes and scan electrodes, $X_1$-$Y_1$, $X_3$-$Y_3$, . . . , $X_{2i-1}$-$Y_{2n-1}$, and also between the even-numbered sustain electrodes and scan electrodes, $X_2$-$Y_2$, $X_4$-$Y_4$, . . . , $X_{2i}$-$Y_{2n}$, which form the non-display slits.

As a modified example of the present embodiment, the electrodes to which the pulses Vs and −Vw are applied can be interchanged. That is, in the odd field, the negative polarity pulse −Vw is applied to the odd-numbered sustain electrodes $X_1$, $X_3$, . . . , $X_{2i+1}$ and the positive polarity pulse Vs to the odd-numbered scan electrodes $Y_1$, $Y_3$, . . . , $Y_{2n-1}$. At the same time, the positive polarity pulse Vs is applied to the even-numbered sustain electrodes $X_2$, $X_4$, . . . , $X_{2i}$ and the negative polarity pulse −Vw to the even-numbered scan electrodes $Y_2$, $Y_4$, . . . , $Y_{2n}$. Likewise, in the even field, the negative polarity pulse −Vw is applied to the odd-numbered scan electrodes $Y_1$, $Y_3$, . . . , $Y_{2n-1}$ and the positive polarity pulse Vs to the even-numbered sustain electrodes $X_2$, $X_4$, . . . , $X_{2i}$. At the same time, the positive polarity pulse Vs is applied to the even-numbered scan electrodes $Y_2$, $Y_4$, . . . , $Y_{2n}$ and the negative polarity pulse −Vw to the odd-numbered sustain electrodes $X_1$, $X_3$, . . . , $X_{2i-1}$.

Figure 2A:
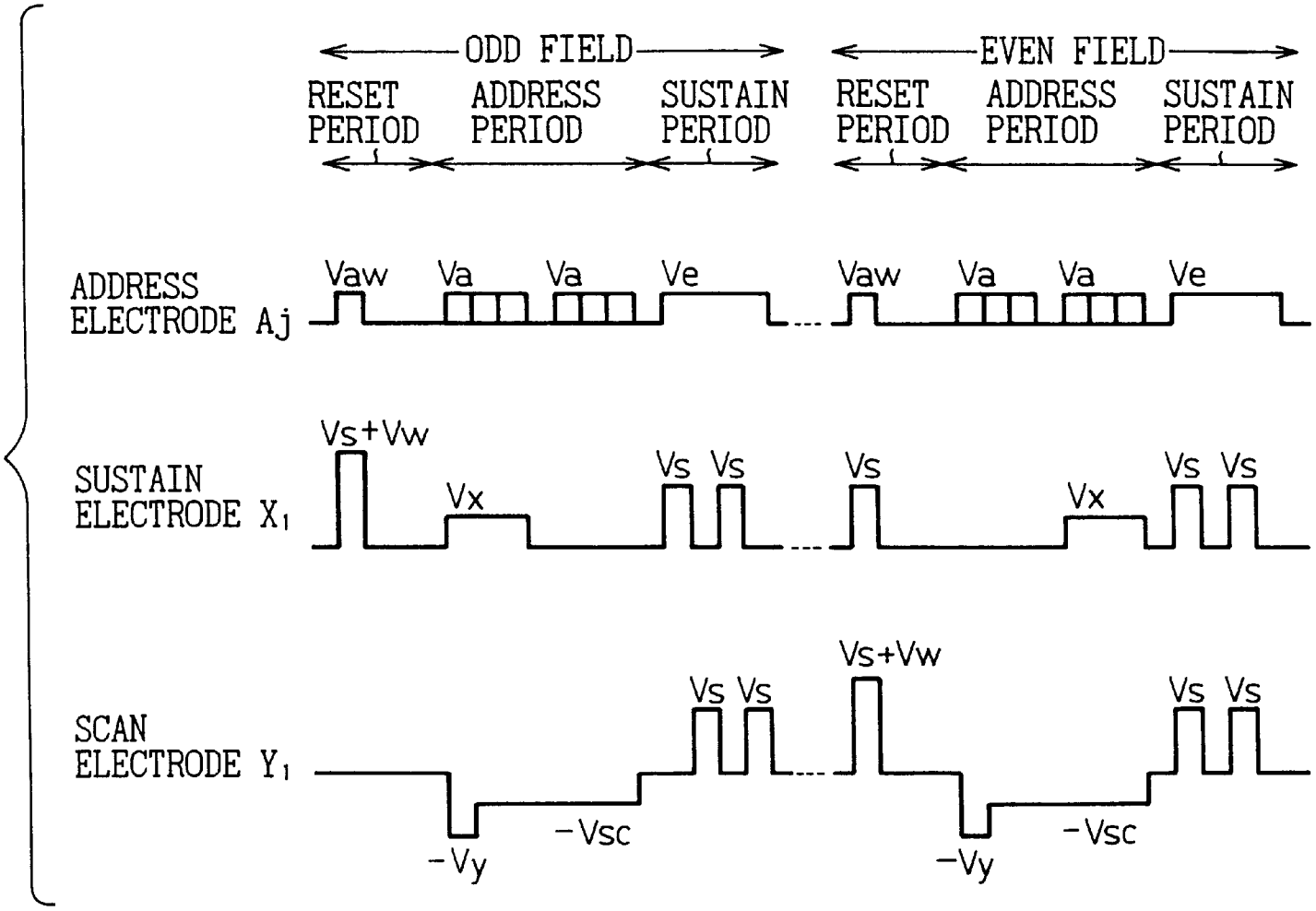
FIGS. 2*a* and 2*b* are waveform diagrams illustrating a second embodiment of the present invention.
Figure 2B:
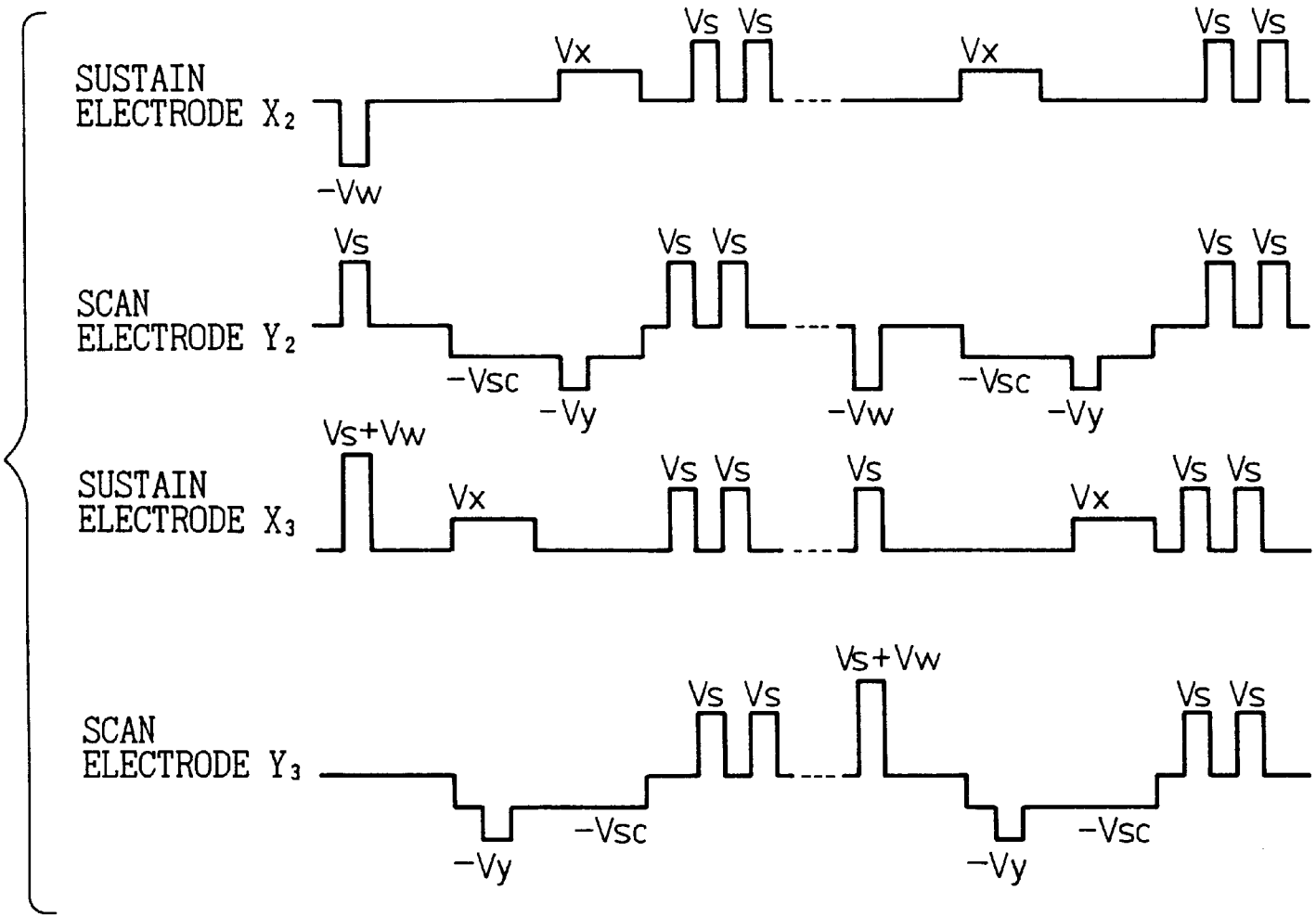

FIGS. 2*a* and 2*b* are waveform diagrams illustrating a second embodiment of the present invention. This embodiment is the same as the second embodiment, except the reset period in each field.

In this embodiment, the slits where the voltage of Vs+Vw exceeding the inter-electrode discharge initiating voltage is applied, as in the prior art, are provided alternately with the slits where the positive polarity pulse Vs and negative polarity pulse −Vw are applied as in the first embodiment.

More specifically, in the odd field, between the odd-numbered scan electrodes and sustain electrodes, $X_1$-$Y_1$, $X_3$-$Y_3$, . . . , $X_{2i-1}$-$Y_{2n-1}$, the scan electrodes $Y_1$, $Y_3$, . . . , $Y_{2n-1}$ are held at ground potential, and the pulse of Vs+Vw is applied to the sustain electrodes $X_1$, $X_3$, . . . , $X_{2i-1}$, while between the even-numbered scan electrodes and sustain electrodes, $X_2$-$Y_2$, $X_4$-$Y_4$, . . . , $X_{2i}$-$Y_{2n}$, the negative polarity pulse −Vw is applied to the sustain electrodes $X_2$, $X_4$, . . . , $X_{2i}$ and the positive polarity pulse Vs to the scan electrodes $Y_2$, $Y_4$, . . . , $Y_{2n}$. As a result, between the odd-numbered scan electrodes and even-numbered sustain electrodes, $Y_1$-$X_2$, $Y_3$-$X_4$, . . . , $Y_{2n-1}$-$X_{2i}$, and also between the even-numbered scan electrodes and odd-numbered sustain electrodes, $Y_2$-$X_3$, $Y_4$-$X_5$, . . . , $Y_{2n}$-$X_{2i-1}$, the potential difference does not reach the discharge initiating voltage, so that discharge does not occur between them. At this time, it is desirable that a prescribed pulse Vaw be applied to the address electrodes $A_j$ to prevent discharge from occurring between the odd-numbered sustain electrodes $X_1$, $X_3$, . . . , $X_{2i-1}$, where Vs+Vw is applied, and the address electrodes $A_j$. As for the magnitude of the pulse Vaw, it should be set to a potential between an intermediate potential between the odd-numbered scan electrodes and sustain electrodes, $X_1$-$Y_1$, $X_3$-$Y_3$, $X_{2i-1}$-$Y_{2n-1}$, and an intermediate potential between the even-numbered scan electrodes and sustain electrodes, $X_2$-$Y_2$, $X_4$-$Y_4$, . . . , $X_{2i}$-$Y_{2n}$. In the present embodiment, the pulse Vaw is set at the same potential as the data pulse Va to simplify driver circuitry.

The driving in the even field is essentially the same as that in the odd field, except that the display and non-display slits are interchanged; therefore, description thereof is omitted.

As a modified example of the second embodiment, the electrodes to which Vs+Vw is to be applied can be changed to the scan electrodes. That is, in the odd field, between the odd-numbered scan electrodes and sustain electrodes, $X_1$-$Y_1$, $X_3$-$Y_3$, . . . , $X_{2i-1}$-$Y_{2n-1}$, the sustain electrodes $X_1$, $X_3$, . . . , $X_{2i-1}$ are held at ground potential, and the pulse of Vs+Vw is applied to the scan electrodes $Y_1$, $Y_3$, . . . , $Y_{2n-1}$. In this case, between the even-numbered scan electrodes and sustain electrodes, $X_2$-$Y_2$, $X_4$-$Y_4$, . . . , $X_{2i}$-$Y_{2n}$, the positive polarity pulse Vs is applied to the sustain electrodes $X_2$, $X_4$, . . . , $X_{2i}$ and the negative polarity pulse −Vw to the scan electrodes $Y_2$, $Y_4$, . . . , $Y_{2n}$. This also applies to the even field.

Also, as a matter of course, it is possible to interchange the slits where Vs+Vw is applied and the slits where the positive polarity pulse Vs and negative polarity pulse −Vw are applied.

Figure 3A:
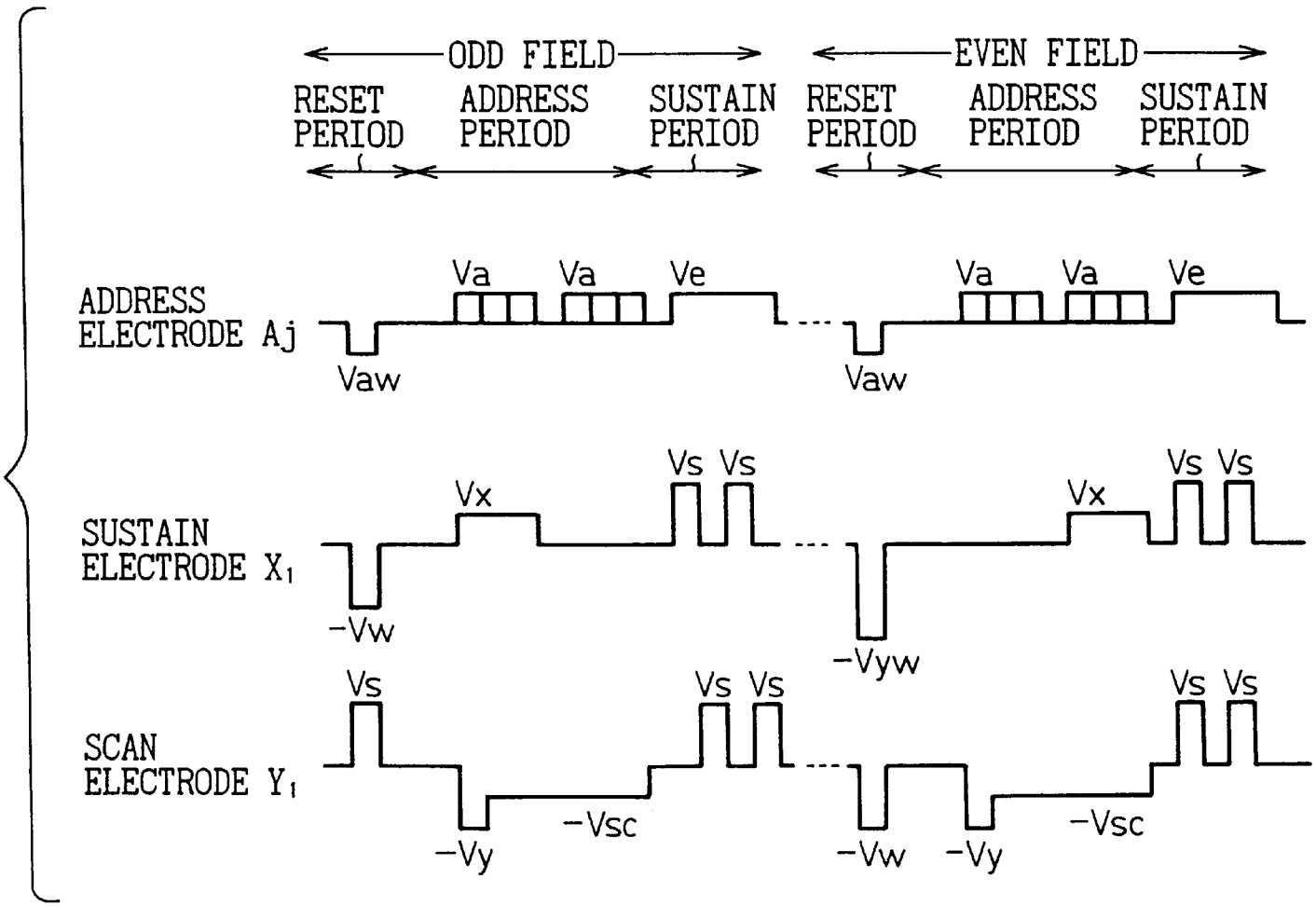
FIGS. 3*a* and 3*b* are waveform diagrams illustrating a third embodiment of the present invention.
Figure 3B:
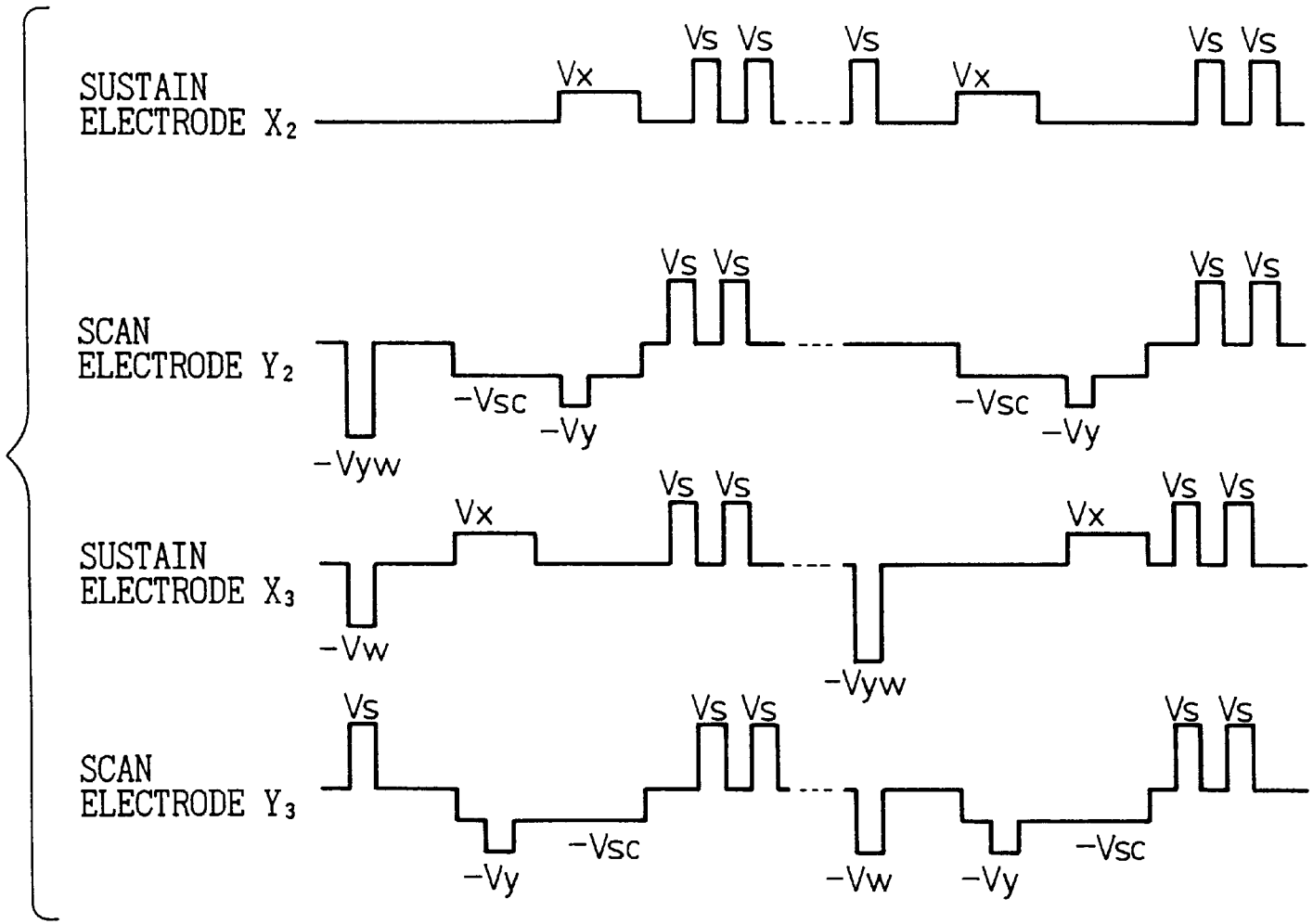

FIGS. 3*a* and 3*b* are waveform diagrams illustrating a third embodiment of the present invention. This embodiment is the same as the first and second embodiments, except the reset period.

In this embodiment, as in the second embodiment, the slits where the pulse exceeding the discharge initiating voltage is applied are provided alternately with the slits where the positive polarity pulse Vs and negative polarity pulse −Vw are applied. The difference in this embodiment is that a negative polarity pulse −Vyw (=−Vs−Vw) is applied as the pulse exceeding the discharge initiating voltage.

More specifically, in the odd field, between the odd-numbered scan electrodes and sustain electrodes, $X_1$-$Y_1$, $X_3$-$Y_3$, . . . , $X_{2i-1}$-$Y_{2n-1}$, the negative polarity pulse −Vw is applied to the sustain electrodes $X_1$, $X_3$, . . . , $X_{2i-1}$ and the positive polarity pulse Vs to the scan electrodes $Y_1$, $Y_3$, . . . , $Y_{2n-1}$, while between the even-numbered scan electrodes and sustain electrodes, $X_2$-$Y_2$, $X_4$-$Y_4$, . . . , $X_{2i}$-$Y_{2n}$, the sustain electrodes $X_2$, $X_4$, . . . , $X_{2i}$ is held at ground potential, and the negative polarity pulse −Vyw is applied to the scan electrodes $Y_2$, $Y_4$, . . . , $Y_{2n}$. As a result, between the odd-numbered scan electrodes and even-numbered sustain electrodes, $Y_1$-$X_2$, $Y_3$-$X_4$, . . . , $Y_{2n-1}$-$X_{2i}$, and also between the even-numbered scan electrodes and odd-numbered sustain electrodes, $Y_2$-$X_3$, $Y_4$-$X_5$, . . . , $Y_{2n}$-$X_{2i-1}$, the potential difference does not reach the discharge initiating voltage, so that discharge does not occur between them. In this case also, it is desirable that the prescribed pulse Vaw be applied to the address electrodes $A_j$ to prevent a discharge from occurring between the even-numbered scan electrodes $Y_2$, $Y_4$, . . . , $Y_{2n}$, where −Vyw is applied, and the address electrodes $A_j$. Here again, it is recommended that the pulse Vaw be set at a potential between an intermediate potential between the odd-numbered scan electrodes and sustain electrodes, $X_1$-$Y_1$, $X_3$-$Y_3$, $X_{2i-1}$-$Y_{2n-1}$, and an intermediate potential between the even-numbered scan electrodes and sustain electrodes, $X_2$-$Y_2$, $X_4$-$Y_4$, . . . , $X_{2i}$-$Y_{2n}$. In this case, the pulse Vaw is set as a negative polarity pulse.

The driving in the even field is essentially the same as that in the odd field, except that the display and non-display slits are interchanged; therefore, a description thereof is omitted.

As a modified example of the third embodiment, the electrodes to which −Vyw is to be applied can be changed to the sustain electrodes. That is, in the odd field, between the even-numbered scan electrodes and sustain electrodes, $X_2$-$Y_2$, $X_4$-$Y_4$, . . . , $X_{2i}$-$Y_{2n}$, the scan electrodes $Y_2$, bx;1$Y_4$, . . . , $Y_{2n}$ are held at ground potential, and the pulse −Vyw is applied to the sustain electrodes $X_2$, $X_4$, . . . , $X_{2i}$. In this case, between the odd-numbered scan electrodes and sustain electrodes, $X_1$-$Y_1$, $X_3$-$Y_3$, . . . , $X_{2i-1}$-$Y_{2n-1}$, the positive polarity pulse Vs is applied to the sustain electrodes $X_1$, $X_3$, . . . , $X_{2i-1}$ and the negative polarity pulse −Vw to the scan electrodes $Y_1$, $Y_3$, . . . , $Y_{2n-1}$. This also applies to the even field.

Also, as a matter of course, it is possible to interchange the slits where the pulse −Vyw is applied and the slits where the positive polarity pulse Vs and negative polarity pulse −Vw are applied.

Figure 4A:
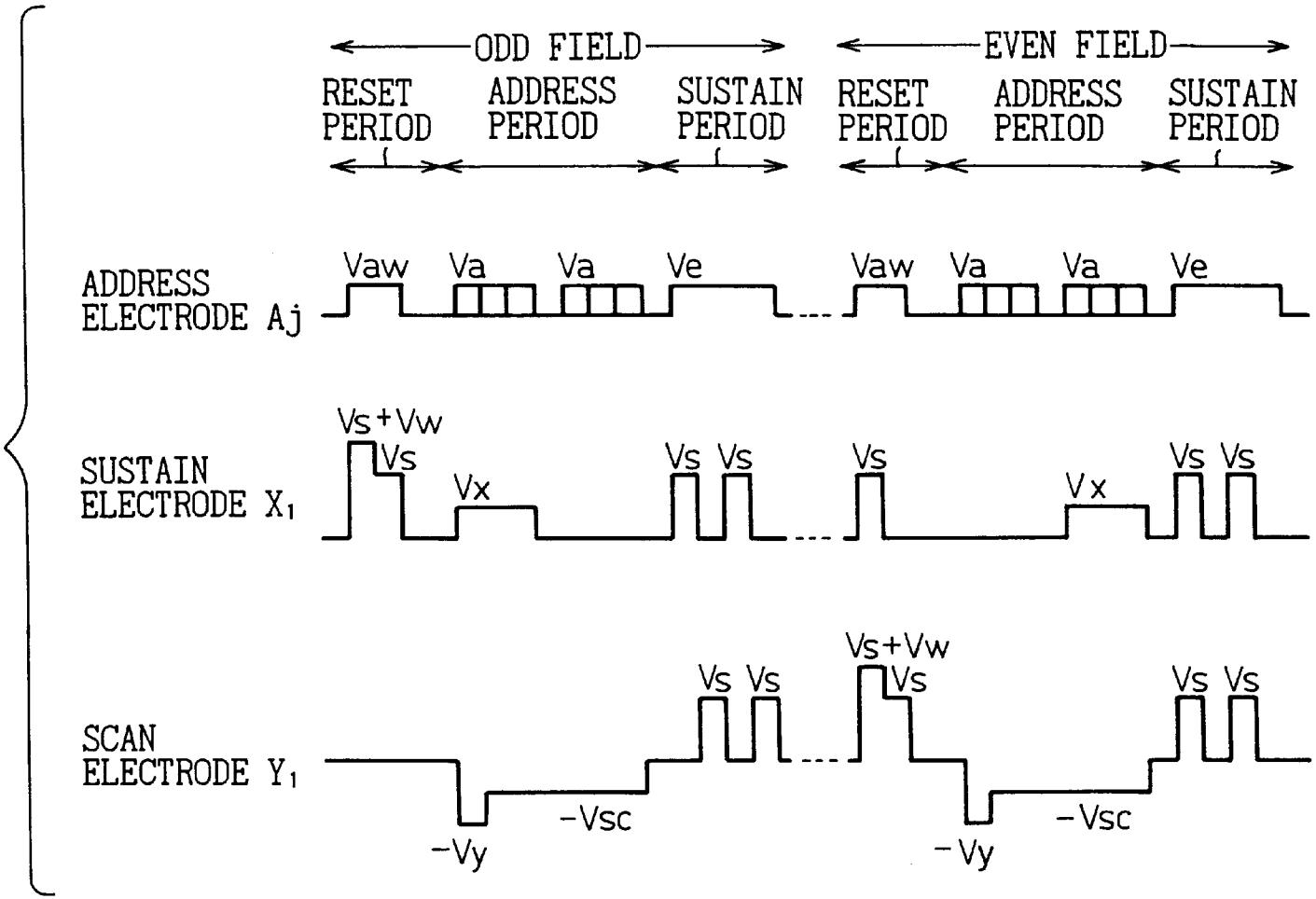
FIGS. 4*a* and 4*b* are waveform diagrams illustrating a fourth embodiment of the present invention.
Figure 4B:
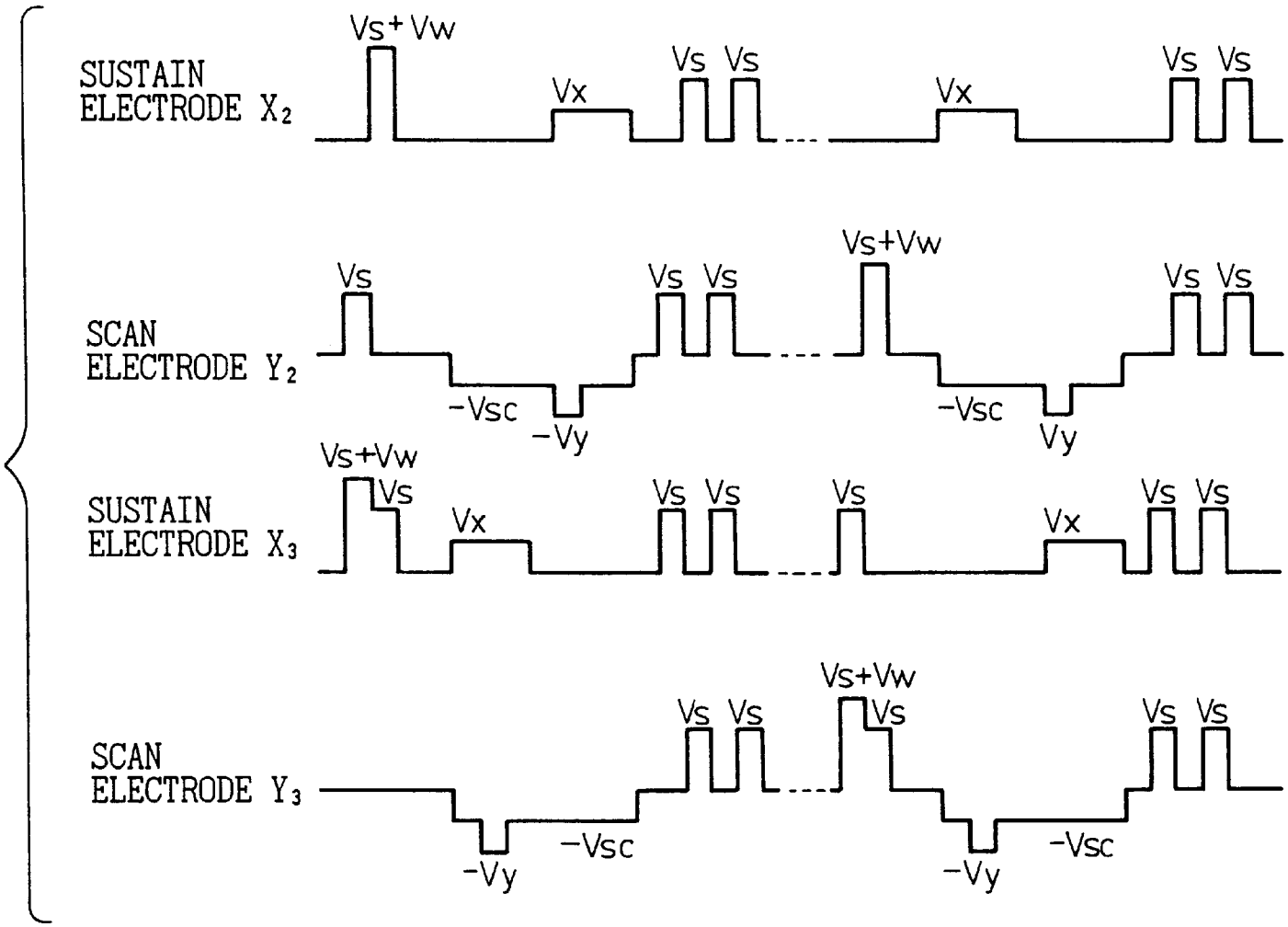

FIGS. 4*a* and 4*b* are waveform diagrams illustrating a fourth embodiment of the present invention. This embodiment also is the same as the foregoing embodiments, except the reset period. A significant difference in this embodiment is that, while in the foregoing first to third embodiments the reset discharge is carried out simultaneously on all the display slits, in the present embodiment the reset discharge is carried out at different times. That is, in the present embodiment, the reset period is divided into a first reset period and a second reset period so that the reset discharge is carried out on the adjacent display slits in the different reset periods.

More specifically, in the first reset period, i.e., in the first half portion of the reset period of the odd field, the reset discharge is carried out between the odd-numbered scan electrodes and sustain electrodes, $X_1$-$Y_1$, $X_3$-$Y_3$, . . . , $X_{2i-1}$-$Y_{2n-1}$, and in the second reset period corresponding to the second half portion, the reset discharge is carried out between the even-numbered scan electrodes and sustain electrodes, $X_2$-$Y_2$, $X_4$-$Y_4$, . . . , $X_{2i}$-$Y_{2n}$. In the present embodiment, in the first reset period of the odd field, the odd-numbered scan electrodes $Y_1$, $Y_3$, . . . , $Y_{2n-1}$ is held at ground potential, and the pulse Vs+Vw exceeding the inter-electrode discharge initiating voltage is applied to the odd-numbered sustain electrodes $X_1$, $X_3$, . . . , $X_{2i-1}$. On the other hand, the even-numbered sustain electrodes $X_2$, $X_4$, . . . , $X_{2i}$ are held at ground potential, and the positive polarity pulse Vs is applied to the even-numbered scan electrodes $Y_2$, $Y_4$, . . . , $Y_{2n}$. As a result, the reset discharge takes place between the odd-numbered scan electrodes and sustain electrodes, $X_1$-$Y_1$, $X_3$-$Y_3$, . . . , $X_{2i-1}$-$Y_{2n-1}$, but the discharge does not occur between the other electrodes since the potential difference between them does not reach the discharge initiating voltage. In the second reset period that follows, the even-numbered scan electrodes $Y_2$, $Y_4$, . . . , $Y_{2n}$ are held at ground potential, and the pulse Vs+Vw exceeding the inter-electrode discharge initiating voltage is applied to the even-numbered sustain electrodes $X_2$, $X_4$, . . . , $X_{2i}$, thereby causing the reset discharge to occur between the even-numbered scan electrodes and sustain electrodes, $X_2$-$Y_2$, $X_4$-$Y_4$, . . . , $X_{2i}$-$Y_{2n}$. On the other hand, the applied voltage to the odd-numbered sustain electrodes $X_1$, $X_3$, . . . , $X_{2i-1}$ is reduced from Vs+Vw to Vs while holding the odd-numbered scan electrodes $Y_1$, $Y_3$, . . . , $Y_{2n-1}$ at ground potential.

Here again, similarly to the first period, it would seem appropriate to apply the pulse Vs to the odd-numbered scan electrodes $Y_1$, $Y_3$, . . . , $Y_{2n-1}$ to prevent a discharge from occurring between the odd-numbered scan electrodes and even-numbered sustain electrodes, $Y_1$-$X_2$, $Y_3$-$X_4$, . . . , $Y_{2n-1}$-$X_{2i}$, but if this were done, a sustain discharge would occur between the odd-numbered scan electrodes and sustain electrodes, $X_1$-$Y_1$, $X_3$-$Y_3$, . . . , $X_{2i-1}$-$Y_{2n-1}$, because of the wall charges formed by the reset discharge in the first reset period. For this reason, the odd-numbered scan electrodes $Y_1$, $Y_3$, . . . , $Y_{2n-1}$ are held at ground potential. However, since positive wall charges are accumulated on the odd-numbered scan electrodes $Y_1$, $Y_3$, . . . , $Y_{2n-1}$, by the reset discharge in the first reset period, and the potential difference between the odd-numbered scan electrodes and even-numbered sustain electrodes, $Y_1$-$X_2$, $Y_3$-$X_4$, . . . , $Y_{2n-1}$-$X_{2i}$ is lowered, discharge does not occur between them. Further, the reason the pulse Vs is applied to the odd-numbered sustain electrodes $X_1$, $X_3$, . . . , $X_{2i-1}$ is that if they were lowered to ground potential, a self-erase discharge would occur between the odd-numbered scan electrodes and sustain electrodes, $X_1$-$Y_1$, $X_3$-$Y_3$, . . . , $X_{2i-1}$, neutralizing the wall charges that should lower the potential difference between the odd-numbered scan electrodes and even-numbered sustain electrodes, $Y_1$-$X_2$, $Y_3$-$X_4$, . . . , $Y_{2n-1}$-$X_{2i}$. In the present embodiment, the self-erase discharge occurs simultaneously in all the display slits after the end of the second reset period.

For the same reason as described in the foregoing embodiments, it is desirable that the prescribed pulse Vaw be applied to the address electrodes $A_j$ throughout the first and second reset periods. Here again, it is recommended that the pulse Vaw be set at a potential between an intermediate potential between the odd-numbered scan electrodes and sustain electrodes, $X_1$-$Y_1$, $X_3$-$Y_3$, $X_{2i-1}$-$Y_{2n-1}$, and an intermediate potential between the even-numbered scan electrodes and sustain electrodes, $X_2$-$Y_2$, $X_4$-$Y_4$, . . . , $X_{2i}$-$Y_{2n}$. In the present embodiment, the pulse Vaw is set to the same potential as the data pulse Va.

The driving in the even field is essentially the same as that in the odd field, except that the display and non-display slits are interchanged; therefore, description thereof is omitted.

As a modified example of the fourth embodiment, the electrodes to which the pulse Vs+Vw is to be applied in the first reset period can be changed to the odd-numbered scan electrodes $Y_1$, $Y_3$, . . . , $Y_{2n-1}$. In this case, the odd-numbered sustain electrodes $X_1$, $X_3$, . . . , $X_{2i-1}$ are held at ground potential, and the pulse Vs is applied to the even-numbered sustain electrodes $X_2$, $X_4$, . . . , $X_{2i}$. In the second reset period that follows, the pulse Vs+Vw is applied to the odd-numbered scan electrodes $Y_1$, $Y_3$, . . . , $Y_{2n-1}$, while the potential of the pulse Vs+Vw being applied to the odd-numbered scan electrodes $Y_1$, $Y_3$, . . . , $Y_{2n-1}$ is reduced to Vs. The even-numbered sustain electrodes $X_2$, $X_4$, . . . , $X_{2i}$ and the odd-numbered sustain electrodes $X_1$, $X_3$, . . . , $X_{2i-1}$ are both at ground potential. The driving in the even field is essentially the same as that in the odd field, except that the display and non-display slits are interchanged.

Further, in the first reset period of the odd field, the pulse Vs+Vw may be applied between the even-numbered scan electrodes and sustain electrodes, $X_2$-$Y_2$, $X_4$-$Y_4$, . . . , $X_{2i}$-$Y_{2n}$, and the pulse Vs applied between the odd-numbered scan electrodes and sustain electrodes, $X_1$-$Y_1$, $X_3$-$Y_3$, . . . , $X_{2i-1}$-$Y_{2n-1}$; in this way, the display slits where the discharge is caused can be interchanged between the first and second reset periods.

Figure 5A:
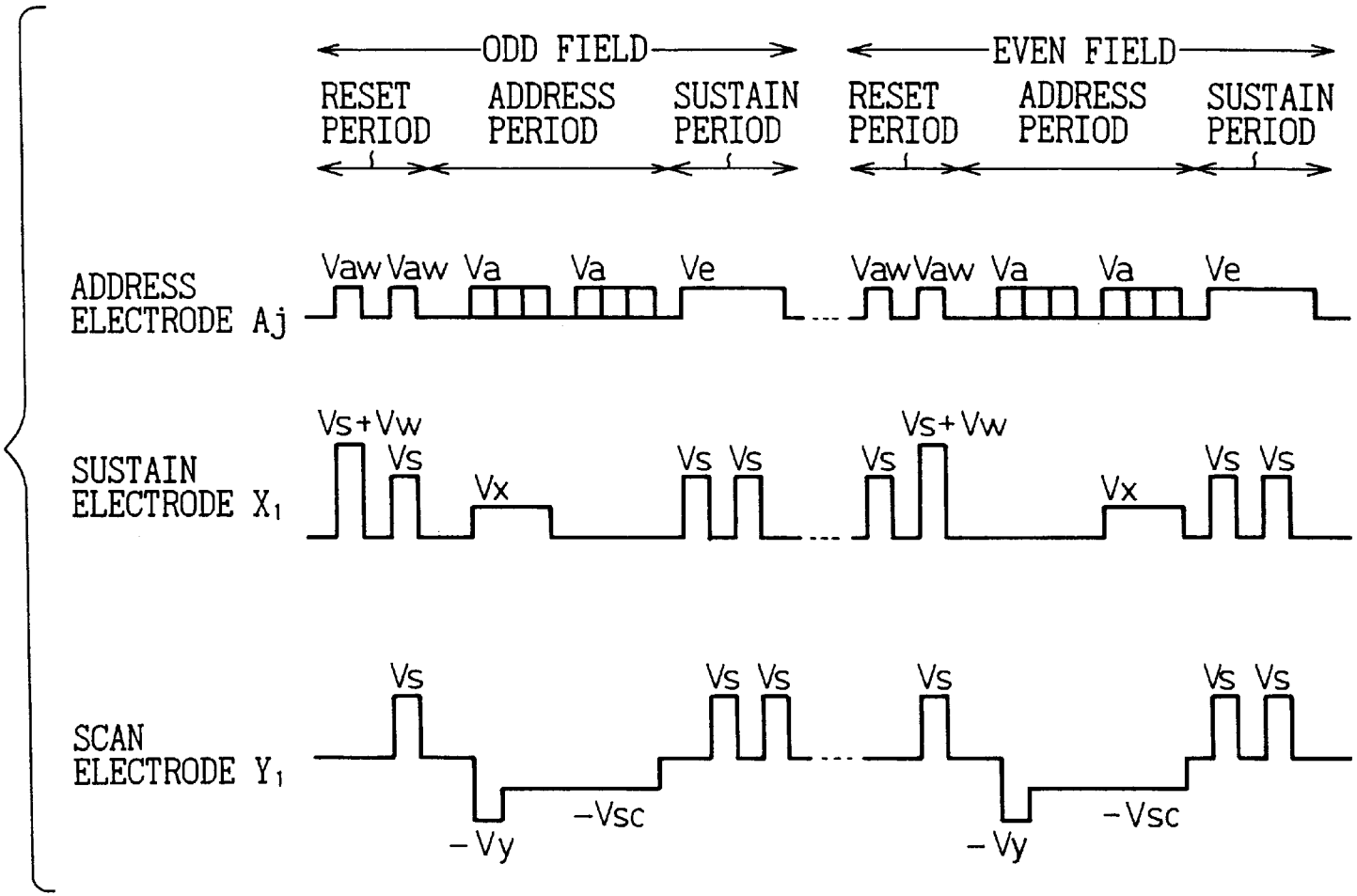
FIGS. 5*a* and 5*b* are waveform diagrams illustrating a fifth embodiment of the present invention.
Figure 5B:
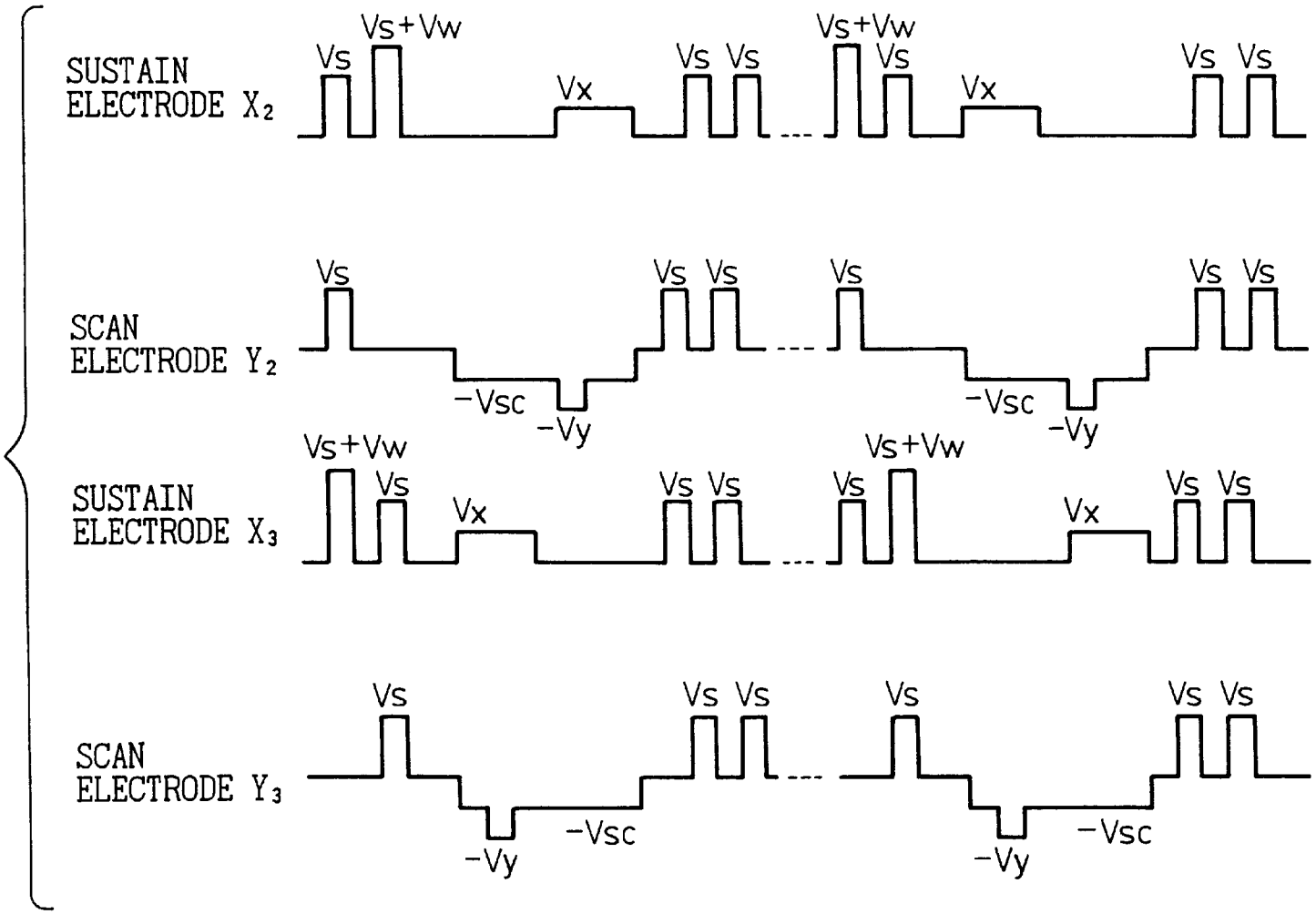

FIGS. 5*a* and 5*b* are waveform diagrams illustrating a fifth embodiment of the present invention. In this embodiment also, the reset discharge is carried out on adjacent display slits at different times by dividing the reset period. It can be said that this embodiment is an improved version of the foregoing fourth embodiment.

More specifically, in the first reset period of the odd field, the odd-numbered scan electrodes $Y_1$, $Y_3$, . . . , $Y_{2n-1}$ is held at ground potential, and the positive polarity pulse Vs+Vw exceeding the inter-electrode discharge initiating voltage is applied to the odd-numbered sustain electrodes $X_1$, $X_3$, . . . , $X_{2i-1}$, as in the fourth embodiment. On the other hand, the positive polarity pulse Vs is applied to both the even-numbered sustain electrodes $X_2$, $X_4$, . . . , $X_{2i}$ and the even-numbered scan electrodes $Y_2$, $Y_4$, . . . , $Y_{2n}$. As a result, the reset discharge takes place only between the odd-numbered scan electrodes and sustain electrodes, $X_1$-$Y_1$, $X_3$-$Y_3$, . . . , $X_{2i-1}$-$Y_{2n-1}$, while preventing the discharge from occurring between the other electrodes. In this case, the positive pulse Vs+Vw may be applied to the odd-numbered scan electrodes $Y_1$, $Y_3$, . . . , $Y_{2n-1}$. In the second reset period that follows, the even-numbered scan electrodes $Y_2$, $Y_4$, . . . , $Y_{2n}$ are held at ground potential, and the positive polarity pulse Vs+Vw is applied to the even-numbered sustain electrodes $X_2$, $X_4$, . . . , $X_{2i}$. On the other hand, the positive polarity pulse Vs is applied to both the odd-numbered sustain electrodes $X_1$, $X_3$, . . . , $X_{2i-1}$ and the odd-numbered scan electrodes $Y_1$, $Y_3$, . . . , $Y_{2n-1}$. As a result, the reset discharge takes place only between the even-numbered scan electrodes and sustain electrodes, $X_2$-$Y_2$, $X_4$-$Y_4$, . . . , $X_{2i}$-$Y_{2n}$, while preventing the discharge from occurring between the other electrodes. In this case, the positive polarity pulse Vs+Vw may be applied to the even-numbered scan electrodes $Y_2$, $Y_4$, . . . , $Y_{2n}$.

In the present embodiment, since the first and second reset periods are completely independent processes, the pulses applied in the respective periods are separated in time. As a result, in the present embodiment, the self-erase discharge occurs separately at the end of each period. Further, the pulse Vaw is applied to the address electrodes $A_j$, as in the foregoing embodiments, but this pulse is also separated between the first and second reset periods.

The driving in the even field is essentially the same as that in the odd field, except that the display and non-display slits are interchanged.

Figure 6A:
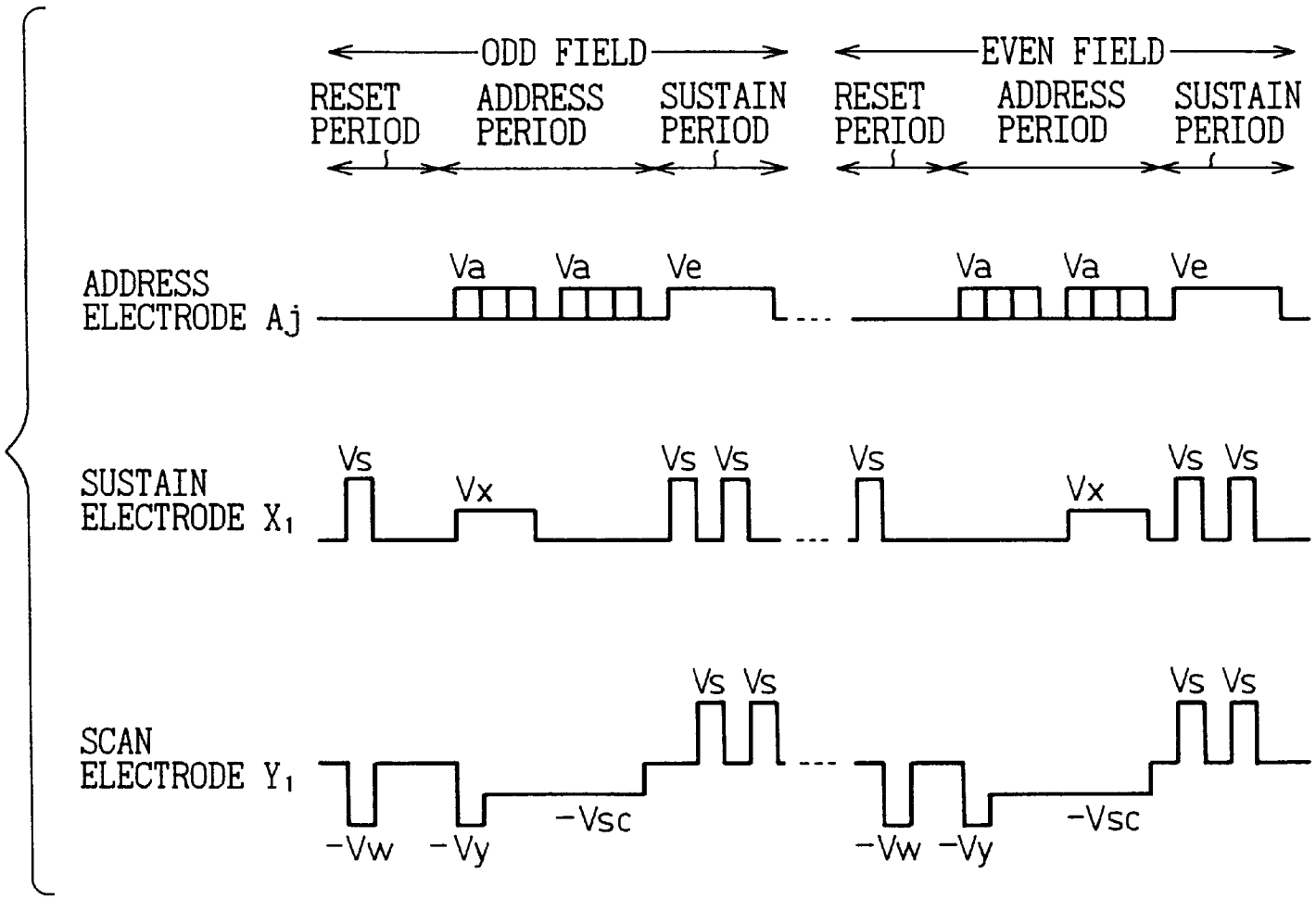
FIGS. 6*a* and 6*b* are waveform diagrams illustrating a sixth embodiment of the present invention.
Figure 6B:
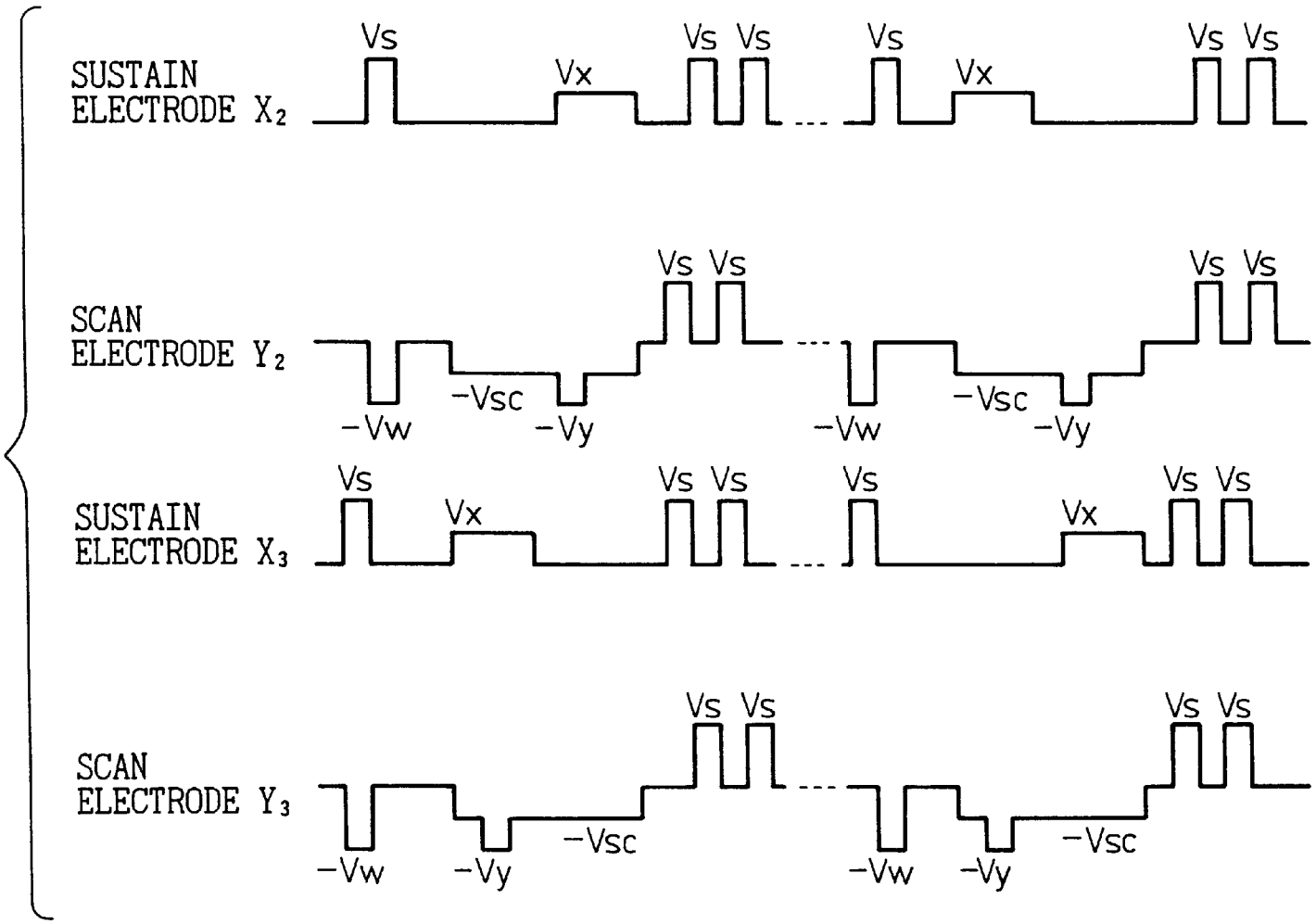

FIGS. 6*a* and 6*b* are waveform diagrams illustrating a sixth embodiment of the present invention. In this embodiment also, the reset discharge is carried out on adjacent display slits at different times by dividing the reset period. The feature of this embodiment is that the same pulses are applied to the adjacent display slits at different times.

More specifically, in the first reset period of the odd field, the positive polarity pulse Vs is applied to the odd-numbered sustain electrodes $X_1$, $X_3$, . . . , $X_{2i-1}$ and the negative polarity pulse −Vw to the odd-numbered scan electrodes $Y_1$, $Y_3$, . . . , $Y_{2n-1}$. At this time, the even-numbered sustain electrodes $X_2$, $X_4$, . . . , $X_{2i}$ and scan electrodes $Y_2$, $Y_4$, . . . , $Y_{2n}$, which form the adjacent display slits, are both held at ground potential. As a result, the reset discharge takes place only between the odd-numbered scan electrodes and sustain electrodes, $X_1$-$Y_1$, $X_3$-$Y_3$, . . . , $X_{2i-1}$-$Y_{2n-1}$, while preventing the discharge from occurring between the other electrodes. In the second reset period that follows, the positive polarity pulse Vs is applied to the even-numbered sustain electrodes $X_2$, $X_4$, . . . , $X_{2i}$ and the negative polarity pulse −Vw to the even-numbered scan electrodes $Y_2$, $Y_4$, . . . , $Y_{2n}$. At this time, the odd-numbered sustain electrodes $X_1$, $X_3$, . . . , $X_{2i-1}$, and scan electrodes $Y_1$, $Y_3$, . . . , $Y_{2n-1}$, which form the adjacent display slits, are both held at ground potential. As a result, the reset discharge takes place only between the even-numbered scan electrodes and sustain electrodes, $X_2$-$Y_2$, $X_4$-$Y_4$, . . . , $X_{2i}$-$Y_{2n}$, while preventing the discharge from occurring between the other electrodes.

On the other hand, in the first reset period of the even field, the negative polarity pulse −Vw is applied to the even-numbered scan electrodes $Y_2$, $Y_4$, . . . , $Y_{2n}$ and the positive polarity pulse Vs is applied to the odd-numbered sustain electrodes $X_1$, $X_3$, . . . , $X_{2i-1}$. At this time, the odd-numbered scan electrodes $Y_1$, $Y_3$, . . . , $Y_{2n-1}$ and the even-numbered sustain electrodes $X_2$, $X_4$, . . . , $X_{2i}$, which form the adjacent display slits, are both held at ground potential. As a result, the reset discharge takes place only between the even-numbered scan electrodes and odd-numbered sustain electrodes, $Y_2$-$X_3$, $Y_4$-$X_5$, . . . , $Y_{2n}$-$X_{2i-1}$, while preventing the discharge from occurring between the other electrodes. In the second reset period that follows, the negative polarity pulse −Vw is applied to the odd-numbered scan electrodes $Y_1$, $Y_3$, . . . , $Y_{2n-1}$ and the positive polarity pulse Vs to the even-numbered sustain electrodes $X_2$, $X_4$, . . . , $X_{2i}$. At this time, the even-numbered scan electrodes $Y_2$, $Y_4$, . . . , $Y_{2n}$ and the odd-numbered sustain electrodes $X_1$, $X_3$, . . . , $X_{2i-1}$, which form the adjacent display slits, are both held at ground potential. As a result, the reset discharge takes place only between the odd-numbered scan electrodes and even-numbered sustain electrodes, $Y_1$-$X_2$, $Y_3$-$X_4$, . . . , $Y_{2n-1}$-$X_{2i}$, while preventing the discharge from occurring between the other electrodes. In the present embodiment, since the pulse applied to each electrode has a voltage value less than the discharge initiating voltage, there is no need to apply a pulse to the address electrodes $A_j$.

It should be noted here that the same pulse is applied to the same electrode in the respective reset periods of the odd and even fields. That is, in the reset period, whether in the odd field or in the even field, the pulse applied to the sustain electrodes $X_i$ is Vs, and the pulse applied to the scan electrodes $Y_n$ is −Vw. Accordingly, in the present embodiment, it is possible to select the slits where the reset discharge is to be carried out, depending on whether the reset pulse to be applied to each electrode is applied in the first reset period or in the second reset period. Here, the pulses applied to the sustain electrodes $X_i$ and scan electrodes $Y_n$, respectively, can be interchanged. For example, in the first reset period of the odd field, the negative polarity pulse −Vw is applied to the odd-numbered sustain electrodes $X_1$, $X_3$, . . . , $X_{2i-1}$, and the positive polarity pulse Vs applied to the scan electrodes $Y_1$, $Y_3$, . . . , $Y_{2n-1}$.

Figure 7A:
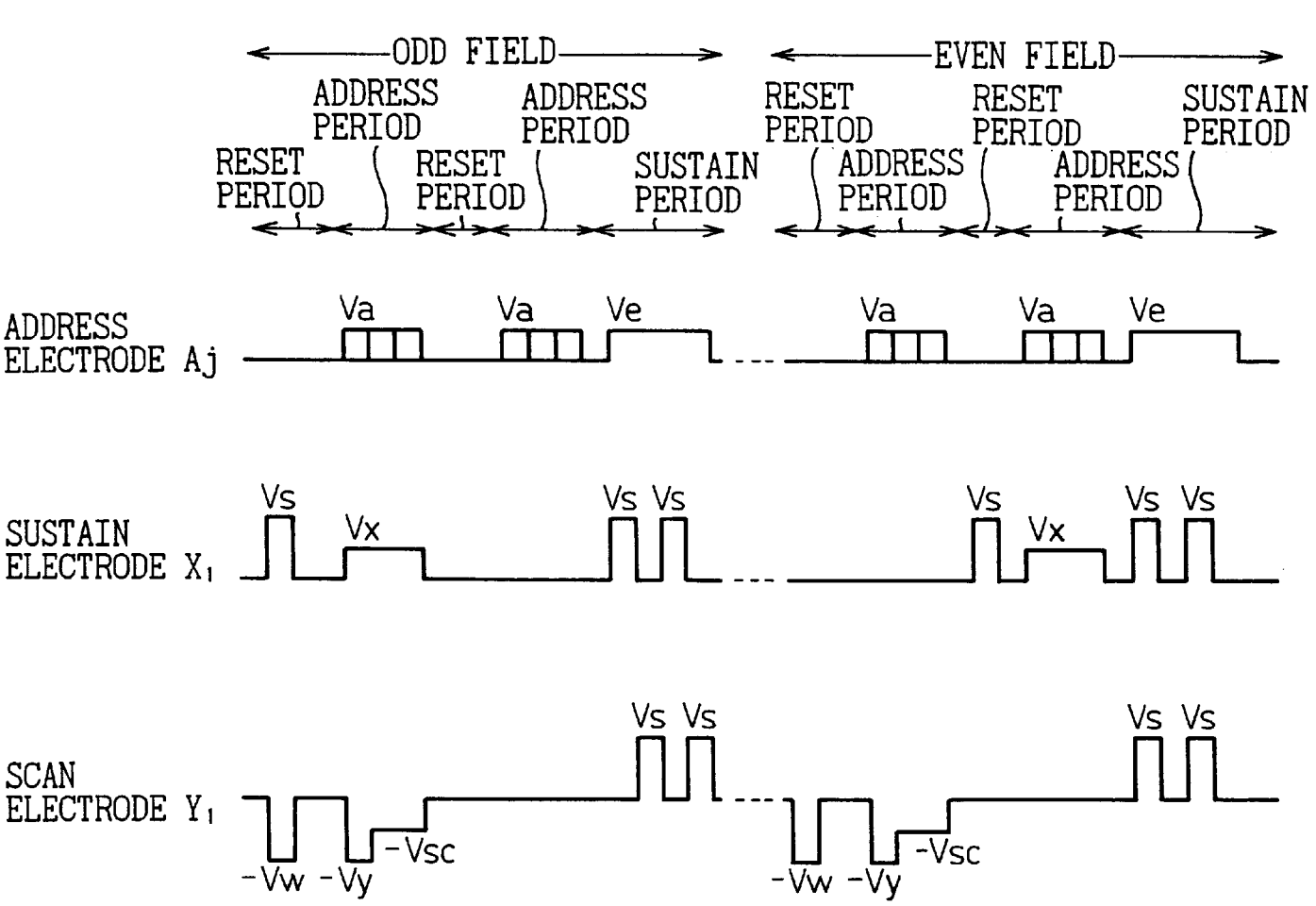
FIGS. 7*a* and 7*b* are waveform diagrams illustrating a seventh embodiment of the present invention.
Figure 7B:
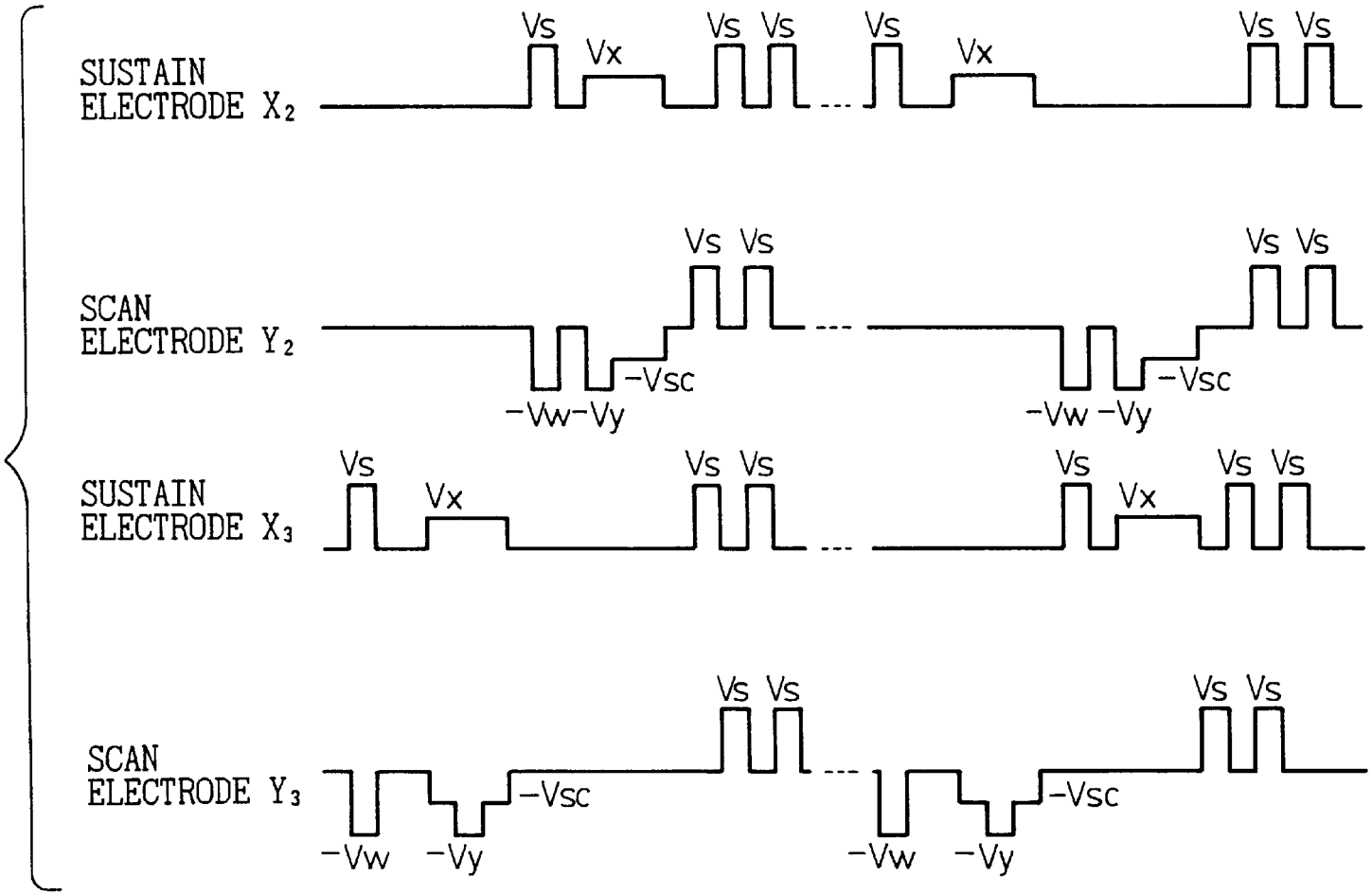

FIGS. 7*a* and 7*b* are waveform diagrams illustrating a seventh embodiment of the present invention. Essentially, this embodiment is an improved version of the sixth embodiment in that the slits between the odd-numbered scan electrodes and even-numbered sustain electrodes, $Y_1$-$X_2$, $Y_3$-$X_4$, . . . , $Y_{2n-1}$-$X_{2i}$ are chosen as the display slits where the reset discharge is carried out in the first reset period of the even field.

In this embodiment, however, the timing at which to carry out the second reset period is changed, and the second reset period is initiated at a point halfway through the address period. More specifically, first the reset discharge in the first reset period is carried out between the odd-numbered scan electrodes and sustain electrodes, $X_1$-$Y_1$, $X_3$-$Y_3$, . . . , $X_{2i-1}$-$Y_{2n-1}$ and then an address discharge is carried out in sequence between the same electrodes, $X_1$-$Y_1$, $X_3$-$Y_3$, . . . , $X_{2i-1}$-$Y_{2n-1}$. After that, the reset discharge in the second reset period is carried out between the even-numbered scan electrodes and sustain electrodes, $X_2$-$Y_2$, $X_4$-$Y_4$, . . . , $X_{2i}$-$Y_{2n}$, and then an address discharge is carried out in sequence between the same electrodes $X_2$-$Y_2$, $X_4$-$Y_4$, . . . , $X_{2i}$-$Y_{2n}$. In this way, in the present embodiment, not only the reset period but the address period is also carried out at different times on the adjacent display splits. In the even field also, the address period is split in the same way as in the odd field.

The method of splitting the address period according to the present embodiment can be applied to any of the foregoing embodiments except the fourth embodiment. The first to third embodiments have been described based on the premise that the reset discharge is carried out at the same time on all the display slits, but it is possible to provide the reset period for one or the other of the adjacent display slits at some point halfway through the address period without changing the pulse applied to each electrode. In the fourth embodiment, on the other hand, since the wall charges formed in the first reset period are used in the second reset period, the two reset periods must be carried out in succession.

When a transition is made from the odd field to the even field or from the even field to the odd field, there occur cases where the wall charges remaining after the end of the discharge in the immediately preceding subfield cannot be erased completely. For example, consider the case where a transition is made from the odd field to the even field. In the odd field, the reset discharge is carried out between the odd-numbered scan electrodes and sustain electrodes, $X_1$-$Y_1$, $X_3$-$Y_3$, . . . , $X_{2i-1}$-$Y_{2n-1}$ and also between the even-numbered scan electrodes and sustain electrodes, $X_2$-$Y_2$, $X_4$-$Y_4$, . . . , $X_{2i}$-$Y_{2n}$. Accordingly, the residual wall charges tend to remain in inner regions between the respective electrodes. Reset discharge is then carried out in the reset period of the first subfield in the even field. This reset discharge is carried out between the odd-numbered scan electrodes and even-numbered sustain electrodes, $Y_1$-$X_2$, $Y_3$-$X_4$, . . . , $Y_{2n-1}$-$X_{2i}$ and also between the even-numbered scan electrodes and odd-numbered sustain electrodes, $Y_2$-$X_3$, $Y_4$-$X_5$, . . . , $Y_{2n}$-$X_{2i-1}$. In this case, the reset discharge is carried out in inner regions between the respective electrodes, thus tending to make it difficult to erase the wall charges remaining in the outer regions, that is, the inner regions between the electrodes where the discharge was carried out in the immediately preceding subfield.

Figure 13A:
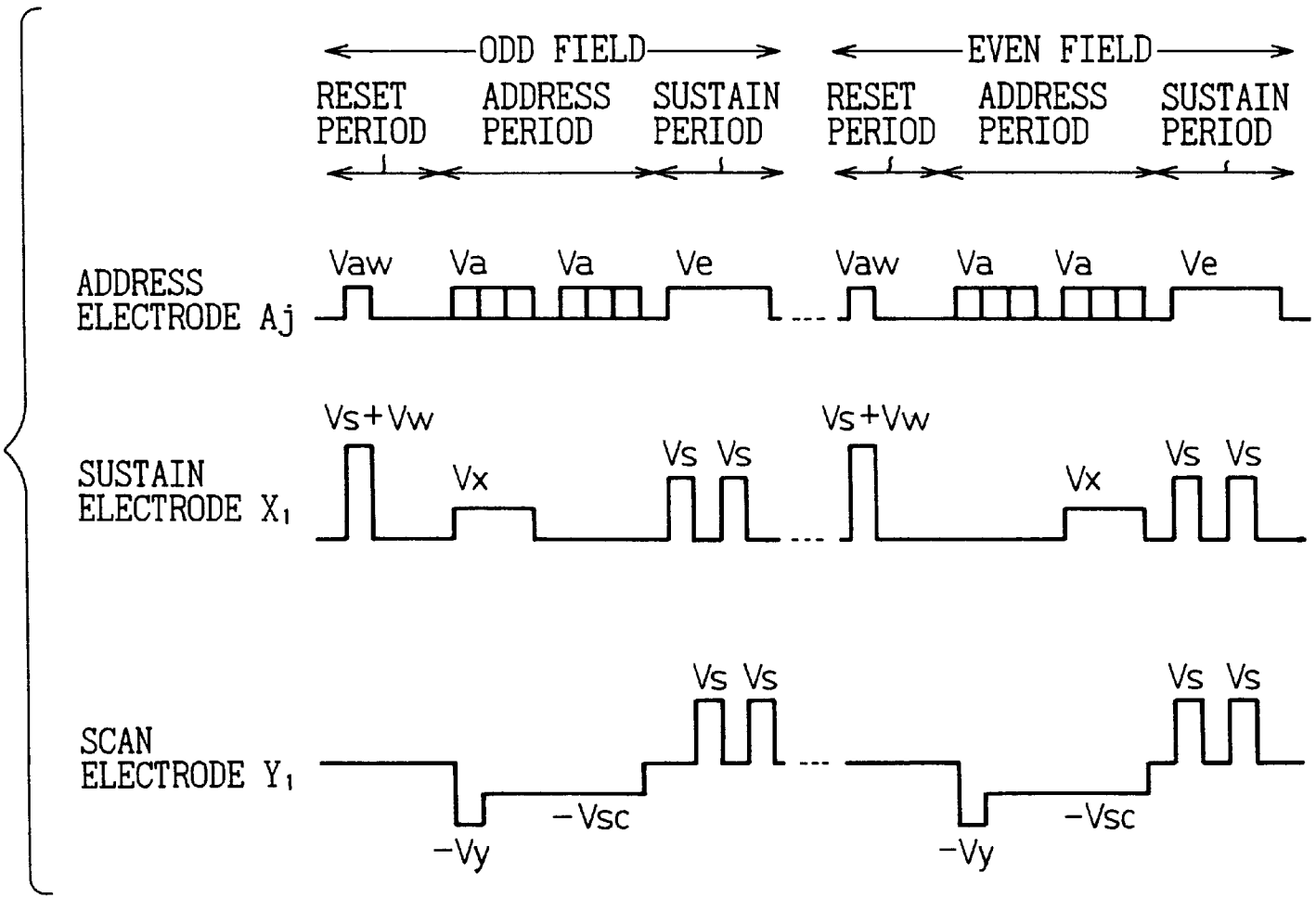
FIGS. 13*a* and 13*b* are waveform diagrams showing interlaced driving according to the prior art.
Figure 13B:
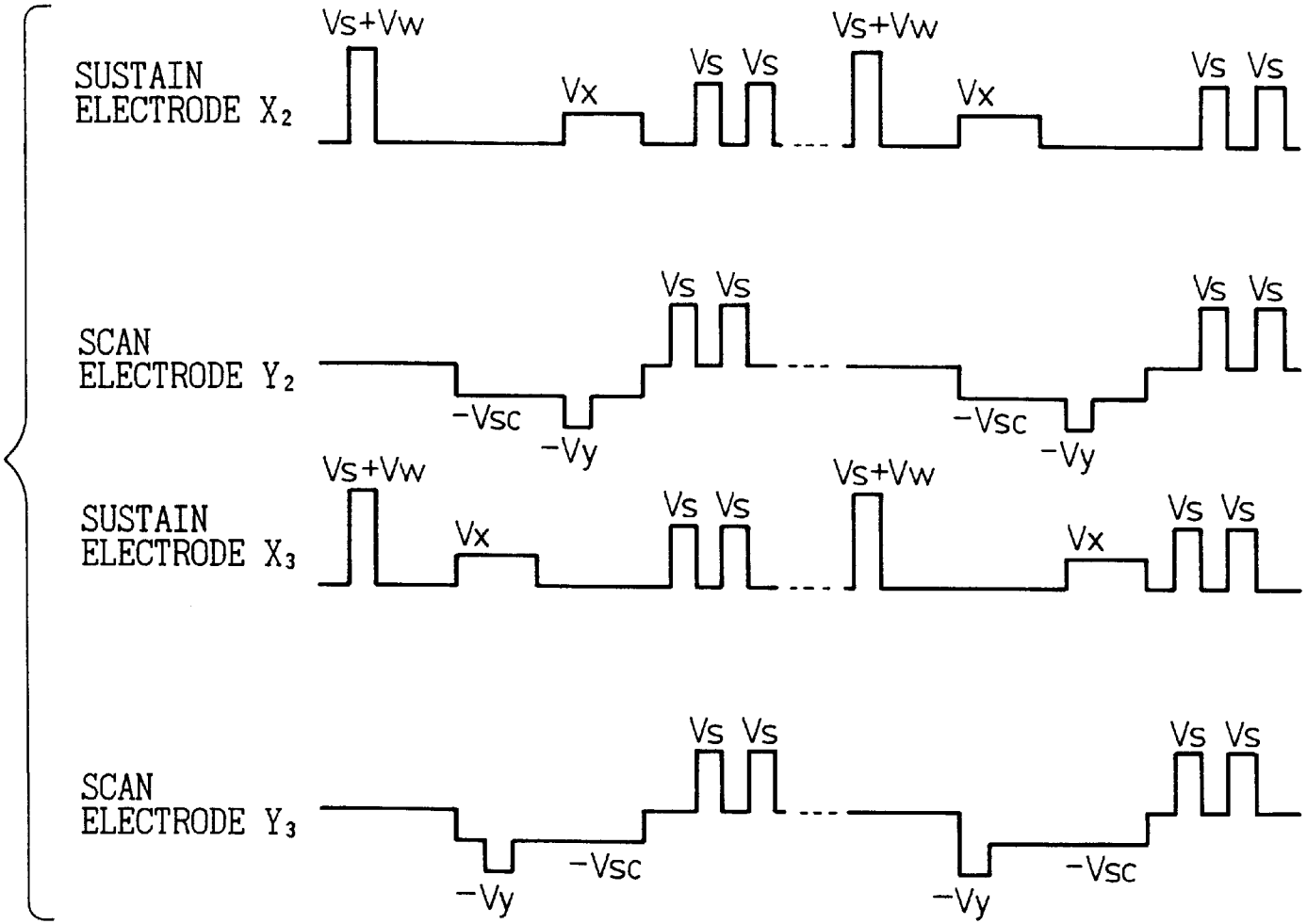

Accordingly, in the present invention, it is desirable that when a transition is made from the odd field to the even field or from the even field to the odd field, the reset discharge be carried out between all the electrodes, including the non-display slits in the new field, as in the prior art described with reference to FIG. 13, but only in the first subfield of the new field. For example, in the first subfield of the odd field or even field, the pulse Vs+Vw exceeding the inter-electrode discharge initiating voltage should be applied to all the sustain electrodes $X_i$ while holding all the scan electrodes $Y_n$ at ground potential.

Figure 8:
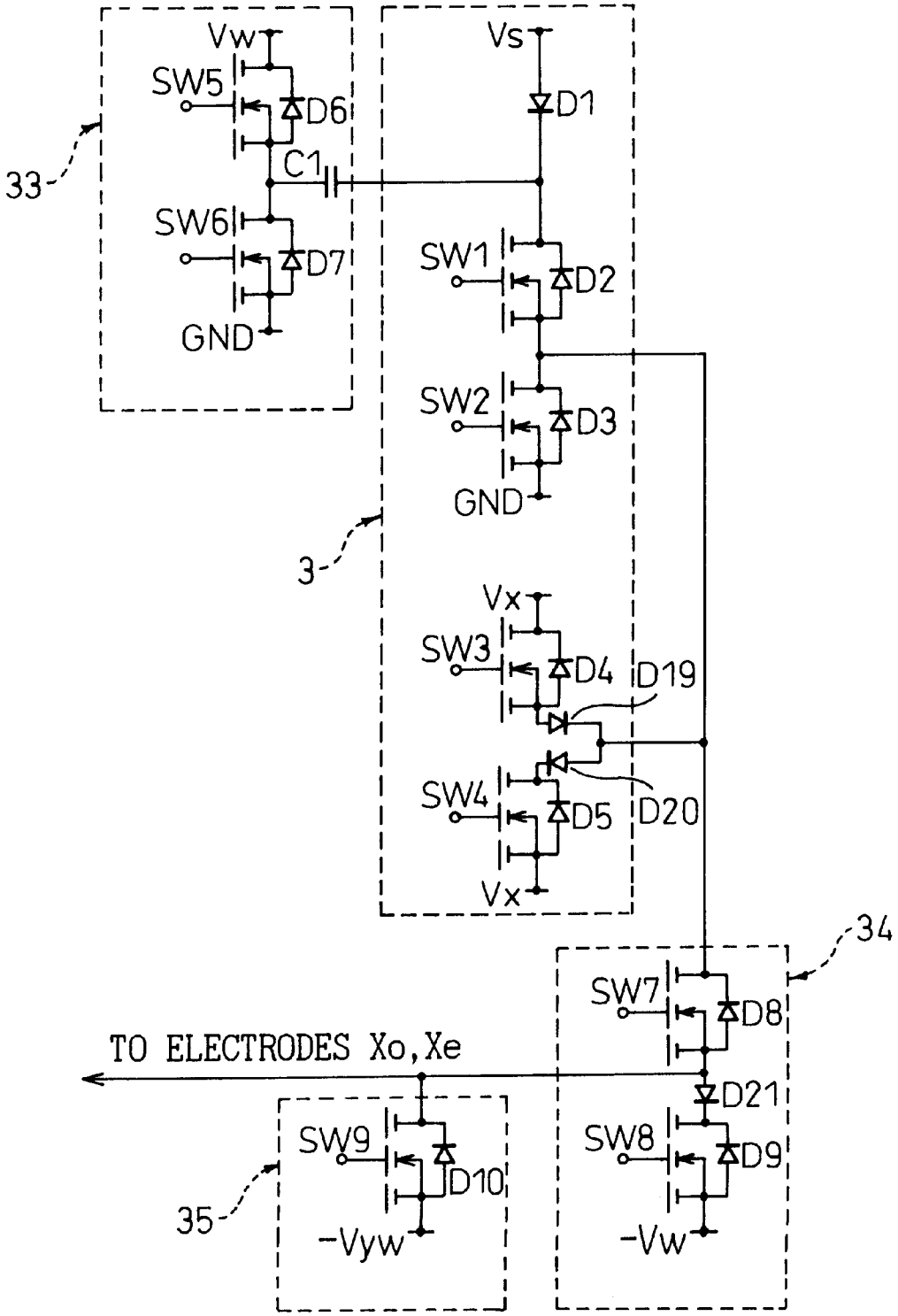
FIG. 8 is a circuit diagram showing an X-side driver according to the present invention.

FIG. 8 is a circuit diagram showing an X-side driver according to the present invention, wherein reference numeral 3 is an X-common driver, 33 is an X positive write circuit, 34 is an X negative write circuit A, and 35 is an X negative write circuit B. Actually, an X-common driver A connected to the odd-numbered electrodes $X_o$ and an X-common driver B connected to the even-numbered electrodes $X_e$ are provided as the X-common driver. Of the X positive write circuit, X negative write circuit A, and X negative write circuit B, in the first embodiment the X negative write circuit A is used when connecting to the even-numbered electrodes $X_e$; in the second embodiment, the X positive write circuit is used when connecting to the odd-numbered electrodes $X_o$ and the X negative write circuit A when connecting to the even-numbered electrodes $X_e$; in the third embodiment, the X negative write circuit A and X negative write circuit B are used when connecting to the odd-numbered electrodes $X_o$; and in the fourth and fifth embodiment, the X positive write circuit is used for the drivers connected to all the drivers. None of the X positive write circuit, X negative write circuit A, and X negative write circuit B are needed in the first embodiment when connecting to the odd-numbered electrodes $X_o$, in the third embodiment when connecting to the even-numbered electrodes $X_e$, and in the sixth and seventh embodiments regardless of the connection.

In the X-common driver, a switch element SW1 and a switch element SW2 are connected in series between a power supply line of potential Vs and a ground line, and diodes D2 and D3 are connected in parallel with the switch elements SW1 and SW2, respectively. Between the switch element SW1 and potential Vs, there is connected a diode D1 with its anode on the potential Vs side. One terminal of a switch element SW3 is connected to the anode of a diode D19, while one terminal of a switch element SW4 is connected to the cathode of a diode D20. The cathode of the diode D19 and the anode of the diode D20 are connected in common, and a power supply line of potential Vx is connected to the other terminals of the switch elements SW3 and SW4. Diodes D4 and D5 are connected in parallel with the switch elements SW3 and SW4, respectively. The cathode of the diode D19 and the anode of the diode D20, which are connected in common, are connected to the node between the switch elements SW1 and SW2 to provide an output of the X-common driver 3.

In the X positive write circuit, a switch element SW5 and a switch element SW6 are connected in series between a power supply line of potential Vw and the ground line, and diodes D6 and D7 are connected in parallel with the switch elements SW5 and SW6, respectively. To the node between the switch elements SW5 and SW6 is connected one end of a capacitor C1 whose other end is connected to the node between the switch element SW1 and diode D1 in the X-common driver 3.

In the X negative write circuit A, one terminal of a switch element SW7 is connected to the output of the X-common driver, while the other terminal thereof is connected to the anode of a diode D21. Further, one terminal of a switch element SWB is connected to a power supply line of −Vw, while the other terminal thereof is connected to the cathode of the diode D21. Diodes D8 and D9 are connected in parallel with the switch elements SW7 and SW8, respectively.

The X negative write circuit B comprises a switch element SW9, connected between a power supply line of −Vyw and the node between the switch element SW7 and diode D21 in the X negative write circuit A, and a diode D10 connected in parallel with the switch element SW9.

The node between the X negative write circuit A and the X negative write circuit B serves an output terminal of the X-side driver for connection to the even-numbered sustain electrodes $X_o$ or odd-numbered sustain electrodes $X_e$. However, when the X negative write circuit A is not used, the output of the X-common driver 3 serves as the output terminal of the X-side driver.

In the reset period, SW1, SW8, and SW9 are turned on as needed, to produce the potentials Vs, −Vw, and −Vyw. When producing Vs+Vw, SW5 is turned on so that the potential Vw is superimposed on the potential Vs being applied to one end of the capacitor C1.

The X negative write circuit A isolates the X-common driver 3 from the potential −Vw by using the switch element SW7. This is done to prevent feed-through current from flowing from the ground potential to the power supply line of −Vw through the diode D3 and through the switch element SW8 when the switch element SW8 is turned on. When the X negative write circuit A is put in operation, the feed-through current can be prevented by turning off the switch element SW7.

In the address period, the pulse Vx for selecting the display slits is generated via the switch elements SW3 and SW4. Here, the two switch elements SW3 and SW4 are used to supply the potential Vx because it has been found that if only one switch element is used, the potential of the sustain electrodes $X_i$ varies through inter-electrode capacitance as the address pulse Va is applied to the address electrodes $A_j$. By taking the output from the node between the two switch elements SW3 and SW4 connected to the power supply line Vx, the variation in the potential of the sustain electrodes $X_i$ can be prevented.

In the sustain period, the switch element SW1 is turned on as needed, to produce the sustain discharge pulse Vs.

In this embodiment, each switch element is constructed from a D-FET which is a power FET capable of supplying large power. The D-FET (shown by a schematic representation for the X-side driver only) passes current only in one direction since essentially its source and drain are fixed, but at the same time, has a parasitic diode directed in the opposite direction. Accordingly, by using the D-FET, the diode connected in parallel with each element can be omitted.

Figure 9:
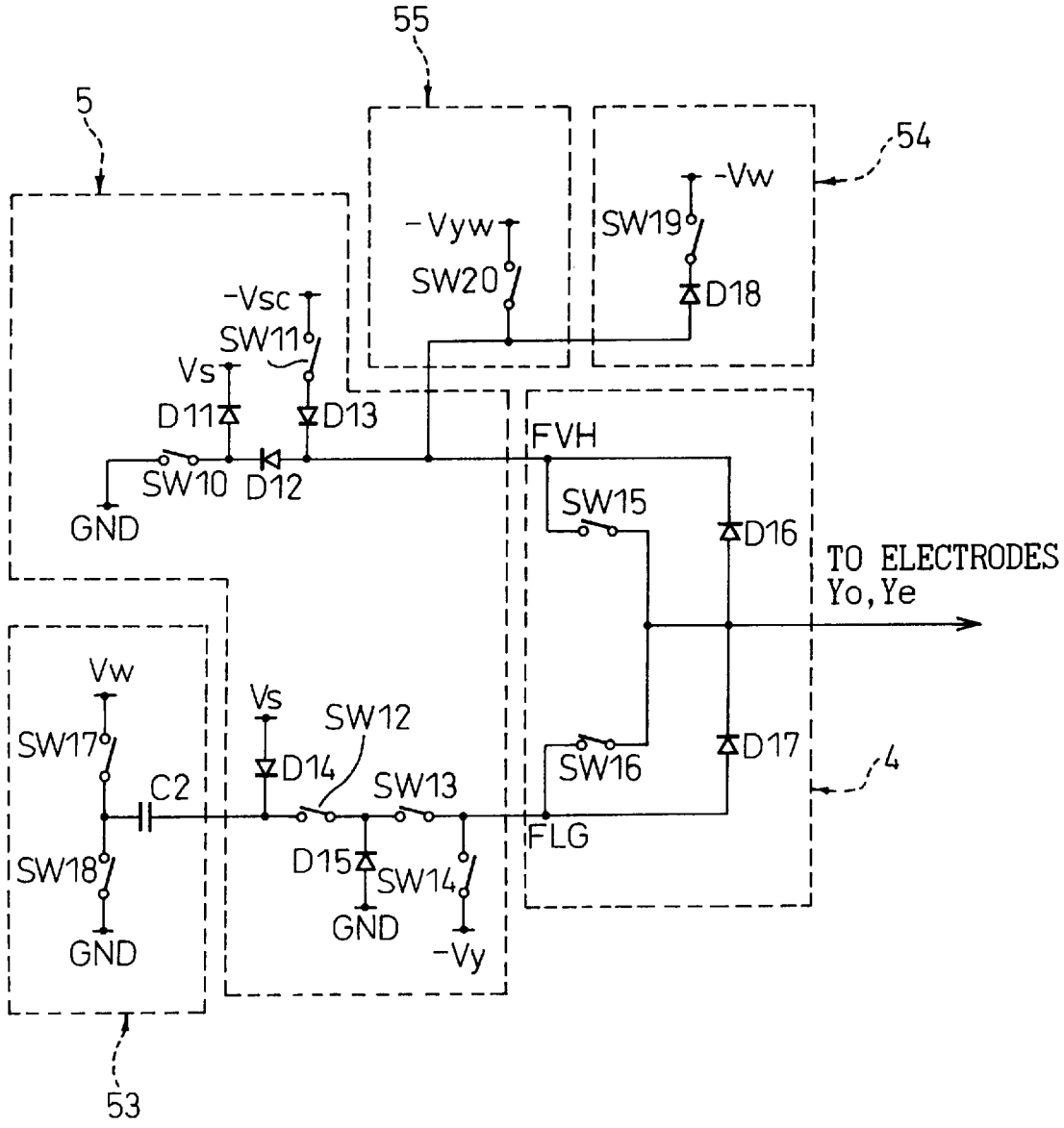
FIG. 9 is a circuit diagram showing Y-side drivers according to the present invention.
Figure 10:
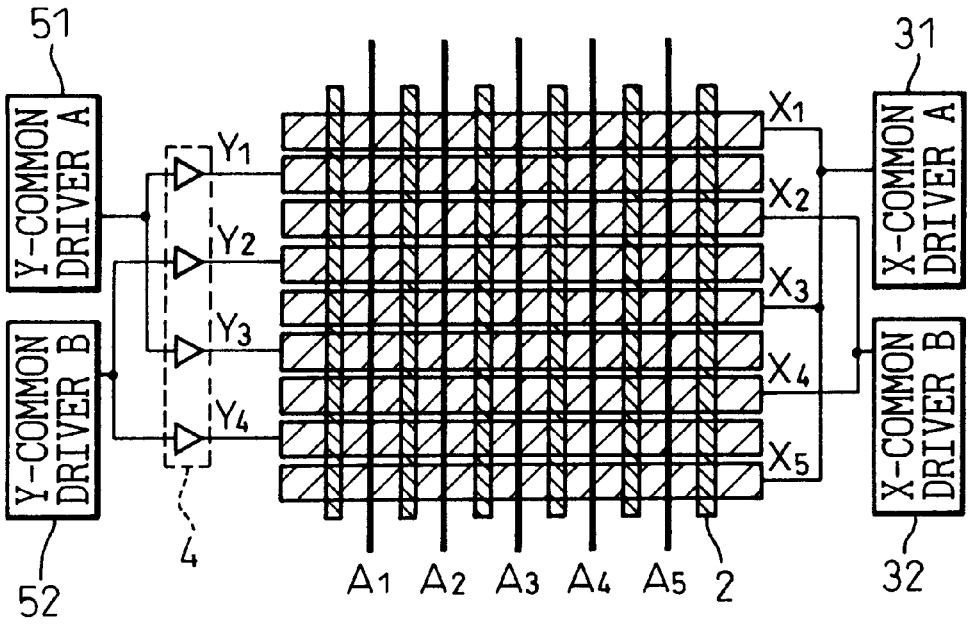
FIG. 10 is a plan view showing an interlaced plasma display panel.
Figure 11:
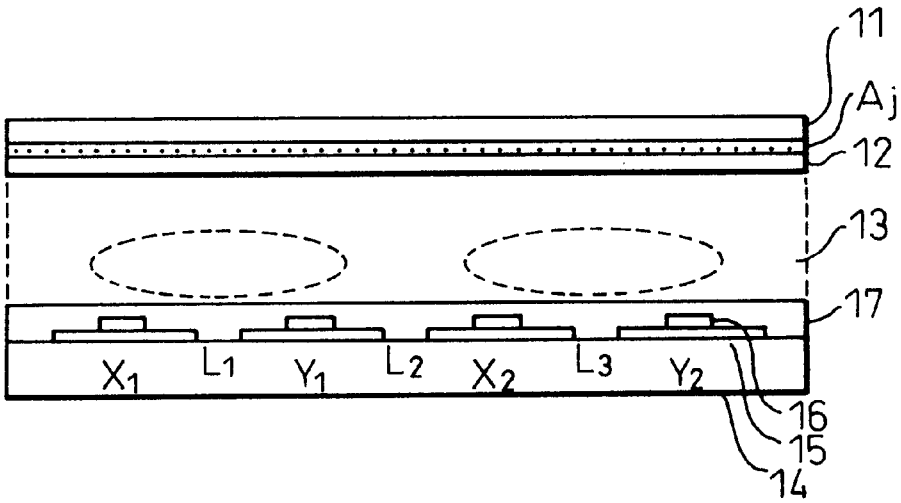
FIG. 11 is a cross-sectional view showing the interlaced plasma display panel.

FIG. 9 is a circuit diagram showing Y-side drivers according to the present invention, wherein reference numeral 4 is a Y-scan driver, 5 is a Y-common driver, 53 is a Y positive write circuit, 54 is a Y negative write circuit A, and 55 is a Y negative write circuit B. Actually, a Y-common driver A connected to the odd-numbered electrodes $Y_o$ and a Y-common driver B connected to the even-numbered electrodes $Y_e$ are provided as the Y-common driver. The Y-scan drivers are connected to individual scan electrodes $Y_i$, one driver driving each electrode independently. The Y-common driver is connected in common to the Y-scan drivers connected to the odd-numbered scan electrodes $Y_o$ or the Y-scan drivers connected to the even-numbered scan electrodes $Y_e$, and drives the odd-numbered scan electrodes $Y_o$ or the even-numbered scan electrodes $Y_e$. Of the Y positive write circuit, Y negative write circuit A, and Y negative write circuit B, in the first, sixth, and seventh embodiments the Y negative write circuit A is used for the drivers connected to all the electrodes; in the second embodiment, the Y positive write circuit is used when connecting to the odd-numbered scan electrodes $Y_o$ and the Y negative write circuit A when connecting to the even-numbered electrodes $Y_e$; in the third embodiment, the Y negative write circuit A is used when connecting to the odd-numbered scan electrodes $Y_o$ and the Y negative write circuit B when connecting to the even-numbered electrodes $Y_e$; and in the fourth embodiment, the Y positive write circuit is used for the drivers connected to all the electrodes. In the fifth embodiment, none of the Y positive write circuit, Y negative write circuit A, and Y negative write circuit B are needed.

In the Y-common driver, one terminal of a switch element SW10 is connected to the ground line, while the other terminal thereof is connected to the power supply line of potential Vs through the anode and cathode of a diode D11 and also to line FVH through the anode and cathode of a diode D12. The line FVH passes through the anode and cathode of a diode D13 and is connected to a power supply line of potential −Vsc through a switch element SW11. The anode of a diode D14 is connected to the power supply line of potential Vs, while the cathode thereof is connected to one terminal of a switch element SW12. The other terminal of the switch element SW12 is connected to the ground line through the anode and cathode of a diode D15 and also to line FLG via a switch element SW13. The line FLG is connected to a power supply line of −Vy via a switch element SW14.

In the Y-scan driver, the anode of a diode D16, the cathode of a diode D17, one terminal of a switch element SW15, and one terminal of a switch element SW16 are connected in common to the associated scan electrode $Y_i$, and the cathode of the diode D16 and the other terminal of the switch SW15 are connected to the line FVH, while the anode of the diode D17 and the other terminal of the switch SW16 are connected to the line FLG.

In the Y positive write circuit, a switch element SW17 and a switch element SW18 are connected in series between the power supply line of potential Vw and the ground line, and one end of a capacitor C2 is connected to the node between the switch elements SW17 and SW18. The other end of the capacitor C2 is connected to the cathode of the diode D14 in the Y-common driver.

The Y negative write circuit A includes a diode D18 whose cathode is connected to the power supply line of potential −Vw via a switch element SW19 and whose anode is connected to the line FVH of the Y-common driver.

The Y negative write circuit B includes a switch element SW20 whose one end is connected to the power supply line of potential −Vyw and whose other end is connected to the line FVH of the Y-common driver.

In the reset period, the switch element SW19 or SW20 is turned on as needed, causing current to flow via the diode D16 to the power supply line of −Vw or −Vyw to drive the odd-numbered electrodes $Y_o$ or the even-numbered electrodes $Y_e$ to the potential −Vw or −Vyw. When supplying the potential Vs, the switch elements SW12 and SW13 are turned on to supply the potential Vs via the diodes D14 and D17. When supplying the potential Vs+Vw, the switch element SW17 is turned on so that the potential Vw is superimposed on the potential Vs being applied to the capacitor C2, and the resulting Vs+Vw is supplied via the diode D17 to the odd-numbered electrodes $Y_o$ or the even-numbered electrodes $Y_e$.

In the address period, by turning the switch elements SW11 and SW14 on and the other switch elements off, the deselect potential −Vsc and select potential −Vy are applied to the scan electrode $Y_i$. At this time, the switch SW13 is turned off to prevent current from flowing to the power supply line of potential −Vy through the diode D15. In this condition, by turning on the switch element SW16 the potential −Vy for the scan pulse is applied to the scan electrode $Y_i$, and by turning on the switch element SW15 the deselect potential −Vsc is applied to the scan electrode $Y_i$. This operation is performed in sequence for the odd-numbered scan electrodes $Y_o$ and even-numbered scan electrodes $Y_e$.

When lowering a positive potential scan electrode $Y_i$ to 0 V, the switch element SW10 is turn on and the other switch elements are turned off. This causes the current for bringing the scan electrode $Y_i$ to 0 V to flow from the scan electrode $Y_i$ and to pass through the diodes D16 and D12 and via the switch element SW10. When raising a negative potential scan electrode $Y_i$ to 0 V, the switch element SW13 is turned on and the other switch elements are turned off. This causes the current for driving the scan electrode $Y_i$ to 0 V to flow from the diode D15 and to pass through the switch element SW13 and diode D17.

In the sustain period, by turning the switch elements SW12 and SW13 on and the other switch elements off, the potential Vs is applied to the scan electrode $Y_i$ through the diode D14, switch elements SW12 and SW13, and diode D17.

What is claimed is:

1. A method of driving a plasma display panel in which a plurality of sustain electrodes $X_i$ and a plurality of scan electrodes $Y_n$ are arranged adjacent to each other on a first substrate in corresponding to display lines, and a plurality of address electrodes $A_j$ electrically isolated from said sustain electrodes $X_i$ and said scan electrodes $Y_n$ are arranged on a second substrate opposing said first substrate, in such a manner as to intersect with said sustain electrodes $X_i$ and said scan electrodes $Y_n$, forming a discharge cell in each intersection comprising:

in an odd field, producing a display between odd-numbered sustain electrodes $X_{2i-1}$ and scan electrodes $Y_{2n-1}$ and between even-numbered sustain electrodes $X_{2i}$ and scan electrodes $Y_{2n}$ and, in an even field, producing a display between the odd-numbered sustain electrodes $X_{2i-1}$ and the even-numbered scan electrodes $Y_{2n}$ and between the even-numbered sustain electrodes $X_{2i}$ and the odd-numbered scan electrodes $Y_{2n-1}$, each of said odd and even fields including a reset period, an address period and a sustain discharge period, the method further comprising:

in each reset period, carrying out a reset discharge in a plurality of said discharge cells to accomplish a uniform charge distribution among said plurality of discharge cells, a reset period, carrying out a write discharge in selected discharge cells between said scan electrodes $Y_n$ and said address electrodes $A_j$, thereby selectively writing display data, and in each sustain discharge period, applying sustain discharge pulses between said sustain electrodes $X_i$ and said scan electrodes $Y_n$, thereby causing a glow discharge for producing said display at said discharge cells in which the writing has been performed in said address period; amd holding respective potential differences between said odd-numbered sustain electrodes $X_{2i-1}$ and said even-numbered scan electrodes $Y_{2n}$ and between said even-numbered sustain electrodes $X_{2i}$ and said odd-numbered scan electrodes $Y_{2n-1}$ during the reset period of said odd field, and respective potential differences between said odd-numbered sustain electrodes $X_{2i-1}$ and scan electrodes $Y_{2n-1}$ and between said even-numbered sustain electrodes $X_{2i}$ and scan electrodes $Y_{2n}$ during the reset period of said even field, below a level of a discharge initiating voltage between the respective electrodes.

2. The method according to claim 1, further comprising:

carrying out said reset discharge in said odd field between said odd-numbered sustain electrodes $X_{2i-1}$ and scan electrodes $Y_{2n-1}$ and between said even-numbered sustain electrodes $X_{2i}$ and scan electrodes $Y_{2n}$ at the same time; and carrying out said reset discharge in said even field between said odd-numbered sustain electrodes $X_{2i-1}$ and said even-numbered scan electrodes $Y_{2n}$ and between said even-numbered sustain electrodes $X_{2i}$ and said odd-numbered scan electrodes $Y_{2n-1}$ at the same time.

3. The method according to claim 2, further comprising: in each of said odd and even fields, carrying out said reset discharge by applying pulses of positive or negative polarity to said sustain electrodes $X_i$ and said scan electrodes $Y_n$, the pulses applied to said sustain electrodes $X_i$ and said scan electrodes $Y_n$ being such that:

in each said odd field, said pulses are opposite in polarity between said odd-numbered sustain electrodes $X_{2i-1}$ and scan electrodes $Y_{2n-1}$ and between said even-numbered sustain electrodes $X_{2i}$ and scan electrodes $Y_{2n}$, and are identical in polarity between said odd-numbered sustain electrodes $X_{2i-1}$ and said even-numbered scan electrodes $Y_{2n}$ and between said even-numbered sustain electrodes $X_{2i}$ and said odd-numbered scan electrodes $Y_{2n-1}$, and in each said even field, said pulses are opposite in polarity between said odd-numbered sustain electrodes $X_{2i-1}$ and said even-numbered scan electrodes $Y_{2n}$ and between said even-numbered sustain electrodes $X_{2i}$ and said odd-numbered scan electrodes $Y_{2n-1}$, and are identical in polarity between said odd-numbered sustain electrodes $X_{2i-1}$ and scan electrodes $Y_{2n-1}$ and between said even-numbered sustain electrodes $X_{2i}$ and scan electrodes $Y_{2n}$.

4. The method according to claim 3, further comprising:

carrying out said reset discharge in said odd field by applying a first pulse of positive polarity to said odd-numbered sustain electrodes $X_{2i-1}$ and said even-numbered scan electrodes $Y_{2n}$ and a second pulse of negative polarity to said even-numbered sustain electrodes $X_{2i}$ and said odd-numbered scan electrodes $Y_{2n-1}$; and carrying out said reset discharge in said even field by applying said first pulse of positive polarity to said odd-numbered sustain electrodes $X_{2i-1}$ and scan electrodes $Y_{2n-1}$ and said second pulse of negative polarity to said even-numbered sustain electrodes $X_{2i}$ and scan electrodes $Y_{2n}$.

5. The method according to claim 3, further comprising:

carrying out said reset discharge in said odd field by applying a first pulse of positive polarity to said even-numbered sustain electrodes $X_{2i}$ and said odd-numbered scan electrodes $Y_{2n-1}$ and a second pulse of negative polarity to said odd-numbered sustain electrodes $X_{2i-1}$ and said even-numbered scan electrodes $Y_{2n}$, and carrying out said reset discharge in said even field by applying said first pulse of positive polarity to said even-numbered sustain electrodes $X_{2i}$ and scan electrodes $Y_{2n}$ and said second pulse of negative polarity to said odd-numbered sustain electrodes $X_{2i-1}$ and scan electrodes $Y_{2n-1}$.

6. The method according to claim 4 further comprising, during said reset discharge in said odd and even fields holding said address electrodes $A_j$ at ground potential.

7. The method according to claim 2, further comprising:

said reset discharge in said odd field by applying first and second pulses of opposite polarities respectively to said sustain electrodes $X_i$ and said scan electrodes $Y_n$ belonging to one electrode group consisting either of said odd-numbered sustain electrodes $X_{2i-1}$ and scan electrodes $Y_{2n-1}$ or of said even-numbered sustain electrodes $X_{2i}$ and scan electrodes $Y_{2n}$, while applying a third pulse of positive polarity greater than said discharge initiating voltage to either said sustain electrodes $X_i$ or said scan electrodes $Y_n$ belonging to the other electrode group; and carrying out said reset discharge in said even field by applying said first and second pulses of opposite polarities respectively to said sustain electrodes $X_i$ and said scan electrodes $Y_n$ belonging to one electrode group consisting of said odd-numbered sustain electrodes $X_{2i-1}$ and said even-numbered scan electrodes $Y_{2n}$ or of said even-numbered sustain electrodes $X_{2i}$ and said odd-numbered scan electrodes $Y_{2n-1}$, while applying said third pulse of positive polarity greater than said discharge initiating voltage to either said sustain electrodes $X_i$ or said scan electrodes $Y_n$ belonging to the other electrode group.

8. The method according to claim 7, further comprising:

in said one electrode group in said odd field, applying said first pulse with a positive polarity to said scan electrodes $Y_n$ and said second pulse with a negative polarity to said sustain electrodes $X_i$ while, in said other electrode group, applying said third pulse of a positive polarity to said sustain electrodes $X_i$; and in said one electrode group in said even field, applying said first pulse of positive polarity to said sustain electrodes $X_i$ and said second pulse of negative polarity to said scan electrodes $Y_n$ while, in said other electrode group, applying said third pulse of positive polarity to said scan electrodes $Y_n$.

9. The method according to claim 8, further comprising:

in said other electrode group in said odd field, holding said scan electrodes $Y_n$ at ground potential; and in said other electrode group in said even field, holding said sustain electrodes $X_i$ at ground potential.

10. The method according to claim 7, further comprising:

in said one electrode group in said odd field, applying said first pulse with a positive polarity to said sustain electrodes $X_i$ and said second pulse with a negative polarity to said scan electrodes $Y_n$ while, in said other electrode group, applying said third pulse of positive polarity to said scan electrodes $Y_n$; and in said one electrode group in said even field, applying said first pulse of positive polarity to said scan electrodes $Y_n$ and said second pulse of negative polarity to said sustain electrodes $X_i$ while, in said other electrode group, applying said third pulse of positive polarity to said sustain electrodes $X_i$.

11. The method according to claim 10, further comprising:

in said other electrode group in said odd field, holding said sustain electrodes $X_i$ at ground potential; and in said other electrode group in said even field, holding said scan electrodes $Y_n$ at ground potential.

12. The method according to claim 8, further comprising:

during said reset discharge in said odd and even fields, holding said address electrodes $A_j$ at a potential not lower than an intermediate potential between the electrodes of said one electrode group but not higher than an intermediate potential between the electrodes of said other electrode group.

13. The method according to claim 12, further comprising:

carrying out said reset discharge in said odd field by applying first and second pulses of opposite polarities respectively to said sustain electrodes $X_i$ and said scan electrodes $Y_n$ belonging to one electrode group consisting either of said odd-numbered sustain electrodes $X_{2i-1}$ and scan electrodes $Y_{2n-1}$ or said even-numbered sustain electrodes $X_{2i}$ and scan electrodes $Y_{2n}$, while applying a fourth pulse of negative polarity greater than said discharge initiating voltage to either said sustain electrodes $X_i$ or said scan electrodes $Y_n$ belonging to the other electrode group; and carrying out said reset discharge in said even field by applying said first and second pulses of opposite polarities respectively to said sustain electrodes $X_i$ and said scan electrodes $Y_n$ belonging to one electrode group consisting either of said odd-numbered sustain electrodes $X_{2i-1}$ and said even-numbered scan electrodes $Y_{2n}$ or of said even-numbered sustain electrodes $X_{2i}$ and said odd-numbered scan electrodes $Y_{2n-1}$, while applying said fourth pulse of negative polarity greater than said discharge initiating voltage to either said sustain electrodes $X_i$ or said scan electrodes $Y_n$ belonging to the other electrode group.

14. The method according to claim 13, further comprising:

in said one electrode group in said odd field, applying said first pulse with a positive polarity to said scan electrodes $Y_n$ and said second pulse with a negative polarity to said sustain electrodes $X_i$ while, in said other electrode group, applying said fourth pulse of negative polarity to said scan electrodes $Y_n$; and in said one electrode group in said even field, applying said first pulse of positive polarity to said sustain electrodes $X_i$ and said second pulse of negative polarity to said scan electrodes $Y_n$ while, in said other electrode group, applying said fourth pulse of negative polarity to said sustain electrodes $X_i$.

15. The method according to claim 14, further comprising:

in said other electrode group in said odd field, holding said sustain electrodes $X_i$ at ground potential; and in said other electrode group in said even field, holding said scan electrodes $Y_n$ at ground potential.

16. The method according to claim 13, further comprising:

in said one electrode group in said odd field, applying said first pulse with a positive polarity to said sustain electrodes $X_i$ and said second pulse with a negative polarity to said scan electrodes $Y_n$ while, in said other electrode group, applying said fourth pulse of negative polarity to said sustain electrodes $X_i$; and in said one electrode group in said even field, applying said first pulse of positive polarity to said scan electrodes $Y_n$ and said second pulse of negative polarity to said sustain electrodes $X_i$ while, in said other electrode group, applying said fourth pulse of negative polarity to said scan electrodes $Y_n$.

17. The method according to claim 16, further comprising:

in said other electrode group in said odd field, holding said scan electrodes $Y_n$ at ground potential; and in said other electrode group in said even field, holding said sustain electrodes $X_i$ at ground potential.

18. The method according to claim 15, further comprising, during said reset discharge in said odd and even fields, holding said address electrodes $A_j$ at a potential not lower than a potential intermediate between the electrodes of said other electrode group but not higher than a potential intermediate between the electrodes of said one group.

19. The method according to claim 1, further comprising:

carrying out said reset discharge in said odd field between said odd-numbered sustain electrodes $X_{2i-1}$ and scan electrodes $Y_{2n-1}$ and between said even-numbered sustain electrodes $X_{2i}$ and scan electrodes $Y_{2n}$ at different times; and carrying out said reset discharge in said even field between said odd-numbered sustain electrodes $X_{2i-1}$ and said even-numbered scan electrodes $Y_{2n}$ and between said even-numbered sustain electrodes $X_{2i}$ and said odd-numbered scan electrodes $Y_{2n-1}$ at different times.

20. The method according to claim 19, wherein in each of said odd and even fields, said reset period includes a first reset period and a second reset period, further comprising: in said odd field:

carrying out a reset discharge in said first reset period between the electrodes belonging to one electrode group consisting either of said odd-numbered sustain electrodes $X_{2i-1}$ and scan electrodes $Y_{2n-1}$ or of said even-numbered sustain electrodes $X_{2i}$ and odd-numbered scan electrodes $Y_{2n}$ and, after which and in said second reset period that follows, carrying out a reset discharge between the electrodes of the other electrode group, in sequence, carrying out an address discharge to produce a display between the electrodes of said one electrode group, and after which and in sequence, carrying out the address discharge to produce a display between the electrodes of said other electrode group, and finally carrying out a sustain discharge between the electrodes of said one electrode group and between the electrodes of said other electrode group; and in said even field:

carrying out a reset discharge in said first reset period between the electrodes belonging to one electrode group consisting either of said odd-numbered sustain electrodes $X_{2i-1}$ and said even-numbered scan electrodes $Y_{2n}$ or of said even-numbered sustain electrodes $X_{2i}$ and odd-numbered scan electrodes $Y_{2n-1}$, after which and in said second reset period that follows, carrying out a reset discharge between the electrodes of the other electrode group, in sequence, carrying out the address discharge to produce a display between the electrodes of said one electrode group, after which and in sequence, carrying out the address discharge to produce a display between the electrodes of said other electrode group, and finally carrying out the sustain discharge between the electrodes of said one electrode group and between the electrodes of said other electrode group.

21. The method according to claim 20, further comprising:

in said odd field and in said first reset period applying a third pulse of positive polarity greater than said discharge initiating voltage between the electrodes of said one electrode group and then, in said second reset period, applying said third pulse of positive polarity greater than said discharge initiating voltage between the electrodes of said other electrode group; and in said even field and in said first reset period, applying said third pulse of positive polarity greater than said discharge initiating voltage between the electrodes of said one electrode group and then, in said second reset period, applying said third pulse of positive polarity greater than said discharge initiating voltage between the electrodes of said other electrode group.

22. The method according to claim 21, further comprising:

in said odd field and in said first reset period, applying said third pulse to the sustain electrodes $X_i$ of said one electrode group while, at the same time, applying a first pulse of positive polarity to the scan electrodes $Y_n$ of said other electrode group and then, in said second reset period, applying said third pulse to the sustain electrodes $X_i$ of said other electrode group while, at the same time, applying said first pulse to the sustain electrodes $X_i$ of said one electrode group; and in said even field and in said first reset period, applying said third pulse to the scan electrodes $Y_n$ of said one electrode group while, at the same time, applying said first pulse of positive polarity to the sustain electrodes $X_i$ of said other electrode group and then, in said second reset period, applying said third pulse to the scan electrodes $Y_n$ of said other electrode group while, at the same time, applying said first pulse to the scan electrodes $Y_n$ of said one electrode group.

23. The method according to claim 21, further comprising:

in said odd field and in said first reset period, applying said third pulse to the scan electrodes $Y_n$ of said one electrode group while, at the same time, applying a first pulse of positive polarity to the sustain electrodes $X_i$ of said other electrode group and then, in said second reset period, applying said third pulse to the scan electrodes $Y_n$ of said other electrode group while, at the same time applying said first pulse to the scan electrodes $Y_n$ of said one electrode group; and in said even field and in said first reset period, applying said third pulse to the sustain electrodes $X_i$ of said one electrode group while, at the same time, applying said first pulse of positive polarity to the scan electrodes $Y_n$ of said other electrode group and then, in said second reset period, applying said third pulse to the sustain electrodes $X_i$ of said other electrode group while, at the same time, applying said first pulse to the sustain electrodes $X_i$ of said one electrode group.

24. The method according to claim 22, further comprising, during said reset periods in said odd and even fields, holding said address electrodes $A_j$ at a potential between an intermediate potential between the electrodes of said one electrode group and an intermediate potential between the electrodes of said other electrode group.

25. The method according to claim 19, wherein, in each of said odd and even fields, said reset period includes a first reset period and a second reset period, further comprising: in said odd field:

carrying out a reset discharge in said first reset period between the electrodes belonging to one electrode group consisting either of said odd-numbered sustain electrodes $X_{2i-1}$ and scan electrodes $Y_{2n-1}$ or of said even-numbered sustain electrodes $X_{2i}$ and scan electrodes $Y_{2n}$, after which and in sequence, carrying out an address discharge to produce a display between the electrodes of said one electrode group, in sequence and in said second reset period, carrying out a reset discharge between the electrodes of the other electrode group, after which and in sequence, carrying out the address discharge to produce a display between the electrodes of said other electrode group, and finally carrying out a sustain discharge between the electrodes of said one electrode group and between the electrodes of said other electrode group; and in said even field:

carrying out a reset discharge in said first reset period between the electrodes belonging to one electrode group consisting either of said odd-numbered sustain electrodes $X_{2i-1}$ and said even-numbered scan electrodes $Y_{2n}$ or of said even-numbered sustain electrodes $X_{2i}$ and odd-numbered scan electrodes $Y_{2n-1}$, after which and in sequence, carrying out the address discharge to produce a display between the electrodes of said one electrode group, in sequence and in said second reset period, carrying out a reset discharge between the electrodes of the other electrode group, after which said and in sequence, carrying out the address discharge to produce a display between the electrodes of said other electrode group, and finally carrying out the sustain discharge between the electrodes of said one electrode group and between the electrodes of said other electrode group.

26. The method according to claim 20, further comprising:

in said odd field:

in said first reset period, applying a third pulse of positive polarity greater than said discharge initiating voltage between the electrodes of said one electrode group while, at the same time, applying a first pulse of positive polarity to said sustain electrodes $X_i$ and scan electrodes $Y_n$ of said other electrode group, and in sequence and in said second reset period, applying said third pulse of positive polarity greater than said discharge initiating voltage between the electrodes of said other electrode group while, at the same time, applying said first pulse of positive polarity to said sustain electrodes $X_i$ and scan electrodes $Y_n$ of said one electrode group; and in said even field:

in said first reset period, applying said third pulse of positive polarity greater than said discharge initiating voltage between the electrodes of said one electrode group while, at the same time, applying said first pulse of positive polarity to said sustain electrodes $X_i$ and scan electrodes $Y_n$ of said other electrode group, and in said second reset period, applying said third pulse of positive polarity greater than said discharge initiating voltage between the electrodes of said other electrode group while, at the same time, applying said first pulse of positive polarity to said sustain electrodes $X_i$ and scan electrodes $Y_n$ of said one electrode group.

27. The method according to claim 20, further comprising:

in said odd field:

in said first reset period, applying first and second pulses of opposite polarities respectively to said sustain electrodes $X_i$ and scan electrodes $Y_n$ of said one electrode group, and in said second reset period, applying said first and second pulses of opposite polarities respectively to said sustain electrodes $X_i$ and scan electrodes $Y_n$ of said other electrode group; and in said even field:

in said first reset period, applying said first and second pulses of opposite polarities respectively to said sustain electrodes $X_i$ and scan electrodes $Y_n$ of said one electrode group; and in said second reset period, applying said first and second pulses of opposite polarities respectively to said sustain electrodes $X_i$ and scan electrodes $Y_n$ of said other electrode group.

28. The method according to claim 1, wherein each of said odd and even fields has a plurality of subfields, each subfield having said reset period, said address period, and said sustain discharge period, further comprising:

when a transition is made from said odd field to said even field or from said even field to said odd field, in the first of said plurality of subfields, holding potential differences between all the sustain electrodes $X_i$ and scan electrodes $Y_n$ not lower than the discharge initiating voltage between the respective electrodes.

29. A plasma display panel in which a plurality of sustain electrodes $X_i$ and a plurality of scan electrodes $Y_n$ are arranged adjacent to each other on a first substrate defining corresponding to display lines, and a plurality of address electrodes $A_j$ electrically isolated from said sustain electrodes $X_i$ and said scan electrodes $Y_n$ are arranged on a second substrate opposing said first substrate, in such a manner as to define intersection regions with said sustain electrodes $X_i$ and said scan electrodes $Y_n$, and form a discharge cell in each intersection region, comprising:

a display control unit producing, in an odd field, a display between odd-numbered sustain electrodes $X_{2i-1}$ and scan electrodes $Y_{2n-1}$ and between even-numbered sustain electrodes $X_{2i}$ and scan electrodes $Y_{2n}$, and an even field display between the odd-numbered sustain electrodes $X_{2i-1}$ and even-numbered scan electrodes $Y_{2n}$ and between the even-numbered sustain electrodes $X_{2i}$ and odd-numbered scan electrodes $Y_{2n-1}$, each of said odd and even fields including a reset period in which a reset discharge is carried out in a plurality of said discharge cells; and a voltage supply holding potential differences between said odd-numbered sustain electrodes $X_{2i-1}$ and said even-numbered scan electrodes $Y_{2n}$ and between said even-numbered sustain electrodes $X_{2i}$ and said odd-numbered scan electrodes $Y_{2n-1}$ during the reset period of said odd field, and potential differences between said odd-numbered sustain electrodes $X_{2i-1}$ and scan electrodes $Y_{2n-1}$ and between said even-numbered sustain electrodes $X_{2i}$ and scan electrodes $Y_{2n}$ during the reset period of said even field, below a discharge initiating voltage between the respective electrodes.

30. A display apparatus comprising:

a plasma display panel in which a plurality of sustain electrodes $X_i$ and a plurality of scan electrodes $Y_n$ are arranged adjacent to each other on a first substrate defining corresponding display lines, and a plurality of address electrodes $A_j$ electrically isolated from said sustain electrodes $X_i$ and said scan electrodes $Y_n$ are arranged on a second substrate opposing said first substrate, in such a manner as to define intersection regions with said sustain electrodes $X_i$ and said scan electrodes $Y_n$, and form a discharge cell in each intersection region; and drive circuits for respectively driving said sustain electrodes $X_i$, said scan electrodes $Y_n$, and said address electrodes $A_j$, in accordance with, in an odd field, producing a display between odd-numbered sustain electrodes $X_{2i-1}$ and scan electrodes $Y_{2n-1}$ and between even-numbered sustain electrodes $X_{2i}$ and scan electrodes $Y_{2n}$, and, in an even field, producing a display between odd-numbered sustain electrodes $X_{2i-1}$ and even-numbered scan electrodes $Y_{2n}$ and between even-numbered sustain electrodes $X_{2i}$ and odd-numbered scan electrodes $Y_{2n-1}$, each of said odd and even fields including a reset period in which a reset discharge is carried out in a plurality of said discharge cells; and a voltage supply holding potential differences between said odd-numbered sustain electrodes $X_{2i-1}$ and said even-numbered scan electrodes $Y_{2n}$ and between said even-numbered sustain electrodes $X_{2i}$ and said odd-numbered scan electrodes $Y_{2n-1}$ during the reset period of said odd field, and potential differences between said odd-numbered sustain electrodes $X_{2i-1}$ and scan electrodes $Y_{2n-1}$ and between said even-numbered sustain electrodes $X_{2i}$ and scan electrodes $Y_{2n}$ during the reset period of said even field, below a discharge initiating voltage between the respective electrodes.

31. A method of driving a plasma display panel in which a plurality of sustain electrodes $X_i$ and a plurality of scan electrodes $Y_n$ are arranged adjacent to each other on a first substrate correspondence to display lines, and a plurality of address electrodes $A_j$ electrically isolated from said sustain electrodes $X_i$ and said scan electrodes $Y_n$ are arranged on a second substrate opposing said first substrate, in such a manner as to intersect with said sustain electrodes $X_i$ and said scan electrodes $Y_n$, forming a discharge cell at each intersection comprising:

producing a display on the plasma display panel in successive image display frames, each image display frame comprising a plurality of subfields, each subfields including a reset period in which a reset discharge is carried out in a plurality of said discharge cells; and in each said first type subfield, carrying out the discharge between odd-numbered sustain electrodes $X_{2i-1}$ and scan electrodes $Y_{2n-1}$ and between even-numbered sustain electrodes $X_{2i}$ and scan electrodes $Y_{2n}$ for display while holding potential differences between said odd-numbered sustain electrodes $X_{2i-1}$ and said even-numbered scan electrodes $Y_{2n}$ and between said even-numbered sustain electrodes $X_{2i}$ and said odd-numbered scan electrodes $Y_{2n-1}$ below a discharge initiating voltage during the reset period, and in said second type subfield, carrying out the discharge between said odd-numbered sustain electrodes $X_{2i-1}$ and said even-numbered scan electrodes $Y_{2n}$ and between said even-numbered sustain electrodes $X_{2i}$ and said odd-numbered scan electrodes $Y_{2n-1}$ for display while holding potential differences between said odd-numbered sustain electrodes $X_{2i-1}$ and said scan electrodes $Y_{2n-I}$ and between said even-numbered sustain electrodes $X_{2i}$ and said scan electrodes $Y_{2n}$ below a discharge initiating voltage during the reset period.

32. A method of driving a plasma display panel in which a plurality of sustain electrodes $X_i$ and a plurality of scan electrodes $Y_n$ are arranged adjacent to each other on a first substrate corresponding display lines, and a plurality of address electrodes $A_j$ electrically isolated from said sustain electrodes $X_i$ and said scan electrodes $Y_n$ are arranged on a second substrate opposing said first substrate, in such a manner as to form intersections with said sustain electrodes $X_i$ and said scan electrodes $Y_n$, and form a discharge cell at each intersection, each image display frame comprising a plurality of subfields and each subfield including a reset period in which a reset discharge is carried out in a plurality of said discharge cells; and the method comprising:

defining, in each image display frame, a first type subfield and a second type subfield;

in said first type subfield, carrying out the discharge between odd-numbered sustain electrodes $X_{2i-1}$ and scan electrodes $Y_{2n-1}$ and between even-numbered sustain electrodes $X_{2i}$ and scan electrodes $Y_{2n-1}$ for display, and holding potential differences between said odd-numbered sustain electrodes $X_{2i-1}$ and said even-numbered scan electrodes $X_{2n}$ and between said even-numbered sustain electrodes $X_{2i}$ and said odd-numbered scan electrodes $Y_{2n-1}$ below a discharge initiating voltage during the reset period; and in said second type subfield, carrying out the discharge between said odd-numbered sustain electrodes $X_{2i-1}$ and said even-numbered scan electrodes $Y_{2n}$ and between said even-numbered sustain electrodes $X_{2i}$ and said odd-numbered scan electrodes $Y_{2n-1}$ for display, and holding potential differences between said odd-numbered sustain electrodes $X_{2i-1}$ and said scan electrodes $Y_{2n-1}$ and between said even-numbered sustain electrodes $X_{2i}$ and said scan electrodes $Y_{2n}$ below a discharge initiating voltage during the reset period.

33. A display apparatus comprising:

a plasma display panel in which a plurality of sustain electrode $X_i$ and a plurality of scan electrodes $Y_n$ are arranged adjacent to each other on a first substrate in correspondence to display lines, and a plurality of address electrodes $A_j$ are arranged in parallel to each other on a second substrate, electrically isolated from said sustain electrodes $X_i$ and said scan electrodes $Y_n$ and opposing said first substrate, in such a manner as to form intersections with said sustain electrodes $X_i$ and said scan electrodes $Y_n$ and to form a discharge cell at each intersection;

drive circuits respectively driving said sustain electrodes $X_i$, said scan electrodes $Y_n$, and said address electrodes $A_3$, to produce a display in accordance with successive image display frames, each image display frame comprising first and second type subfields and each subfields and each subfield comprising a reset period in which a reset discharge is carried out in a plurality of said discharge cells;

in said first type subfield, the drive circuits producing the discharge between odd-numbered sustain electrodes $X_{2i-1}$ and scan electrodes $Y_{2n-1}$ and even-numbered sustain electrodes $X_{2i}$ and scan electrodes $Y_{2n}$ for display, and holding potential differences between said odd-numbered sustain electrodes $X_{2i-1}$ and said even-numbered scan electrodes $Y_{2n}$ and between said even-numbered sustain electrodes $X_{2i}$ and said odd-numbered scan electrodes $Y_{2n-1}$, below a discharge initiating voltage during the reset period; and in said second type subfield, the drive circuits producing the discharge between said odd-numbered sustain electrodes $X_{2i-1}$ and said even-numbered scan electrodes $Y_{2n}$ and between said even-numbered sustain electrodes $X_{2i}$ and said odd-numbered scan electrodes $Y_{2n-1}$ (during said sustain discharge period) for display, and holding potential differences between said odd-numbered sustain electrodes $X_{2i-1}$ and said scan electrodes $Y_{2n-1}$ and between said even-numbered sustain electrodes $X_{2i}$ and said scan electrodes $Y_{2n}$ below a discharge initiating voltage during the reset period.

34. A method of driving a plasma display panel having plural sets of adjacent sustain and scan electrodes, corresponding to respective display lines, and plural address electrodes positioned in opposed relationship to, and electrically isolated from, the sustain and scan electrodes and intersecting same so as to form respective discharge cells at the intersections, the method comprising:

producing an interlaced displace by generating discharges in selected discharge cells, in each of successive odd and even fields and between respective, different, selected sets of the sustain and scan electrodes, each of the odd and even fields including a reset period, an address period and a sustain discharge period, the method further comprising, in each reset period, producing reset discharge in the discharge cells;

holding potential differences between the respective sets of the sustain and scan electrodes of the odd and even fields below a discharge initiating voltage level.

* * * * *

UNITED STATES PATENT AND TRADEMARK OFFICE

CERTIFICATE OF CORRECTION

PATENT NO.: 6,160,529
DATED : December 12, 2000
INVENTOR(S): Shigeharu ASAO et al.

It is certified that error appears in the above-identified patent and that said Letters Patent is hereby corrected as shown below:

Col. 21, line 26, after "$H_j$" insert --,--;
line 27, after "$Y_n$" insert --,--;
line 28, after "substrate" insert --,--;
line 31, after "intersection" insert --,--;
line 42, delete ":" and the paragraph break;
line 43, change "to accomplish a unit-" to --; and--;
lines 44-57, delete in their entirety.

Col. 23, line 2, after "fields" insert --,--;
line 5, before "said reset" insert --carrying out--.

Col. 25, line 27, delete "," and after "wherein" insert --,--;
line 46, after "finally" insert --,--;
line 65, after "finally" insert --,--.

Col. 26, line 3, after "period" insert --,--;
line 46, after "time" insert --,--;
line 64, after "19" delete ",".

Col. 27, line 15, after "finally" insert --,--;
line 35, after "finally" insert --,--.

Col. 28, line 40, after "$Y_n$" delete ",";
line 45, after "and" (second occurrence) insert --, in--;
line 46, after "field" insert --, a--.

UNITED STATES PATENT AND TRADEMARK OFFICE

CERTIFICATE OF CORRECTION

PATENT NO.: 6,160,529
DATED : December 12, 2000
INVENTOR(S): Shigeharu ASAO et al.

It is certified that error appears in the above-identified patent and that said Letters Patent is hereby corrected as shown below:

Col. 29, line 7, delete ",";
between lines 47 and 48, insert the following as a paragraph --each said image display frame having a first type subfield and a second type subfield wherein:--.

Col. 30, line 14, change ";" to --,--;
line 20, delete "-1";
line 52, delete ",";
lines 54-55, delete "and each subfields";
line 66, delete ",".

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*